US011428489B2

(12) United States Patent
Petersen

(10) Patent No.: US 11,428,489 B2
(45) **Date of Patent: *Aug. 30, 2022**

(54) MULTI-BAFFLED FIREARM SUPPRESSOR

(71) Applicant: DELTA P DESIGN, INC., Walterville, OR (US)

(72) Inventor: Byron S. Petersen, Springfield, OR (US)

(73) Assignee: DELTA P DESIGN, INC., Walterville, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/114,261

(22) Filed: Dec. 7, 2020

(65) Prior Publication Data

US 2021/0278160 A1 Sep. 9, 2021

Related U.S. Application Data

(63) Continuation of application No. 16/600,379, filed on Oct. 11, 2019, now Pat. No. 10,890,404, which is a continuation-in-part of application No. 15/904,218, filed on Feb. 23, 2018, now Pat. No. 10,619,963.

(60) Provisional application No. 62/482,621, filed on Apr. 6, 2017.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/34; F41A 21/36; F41A 21/325
See application file for complete search history.

(56) References Cited

U.S. PATENT DOCUMENTS

| | | | | |
|---|---|---|---|---|
| 748,157 A | | 12/1903 | Bouton | |
| 825,010 A | | 7/1906 | Snow | |
| 1,066,898 A | * | 7/1913 | Gray | F41A 21/30 181/223 |
| 1,773,443 A | * | 8/1930 | Wilman | C09B 49/10 89/14.4 |
| 2,101,849 A | * | 12/1937 | Green | F41A 21/34 89/14.5 |
| 2,192,081 A | * | 2/1940 | Hughes | F41A 21/36 89/14.3 |

(Continued)

FOREIGN PATENT DOCUMENTS

| | | |
|---|---|---|
| FR | 492535 A | 7/1919 |
| FR | 493462 A | 8/1919 |

(Continued)

OTHER PUBLICATIONS

European Patent Office, Extended European Search Report Issued in Application No. 18161158.3, dated Sep. 12, 2018, Germany, 13 pages.

*Primary Examiner* — Derrick R Morgan
(74) *Attorney, Agent, or Firm* — McCoy Russell LLP

(57) ABSTRACT

A sound suppressor, comprising an elongate tubular housing, a projectile entrance passage at a rearward portion of the elongate tubular housing, and a plurality of tubes positioned within the elongate tubular housing. In at least one example, the plurality of tubes may be offset from the elongate tubular housing and offset from a central axis of the elongate tubular housing.

19 Claims, 22 Drawing Sheets

(56) References Cited

U.S. PATENT DOCUMENTS

| | | | | |
|---|---|---|---|---|
| 3,898,910 | A * | 8/1975 | Groff | B64D 7/02 89/14.3 |
| 4,341,283 | A * | 7/1982 | Mazzanti | F01N 1/06 181/223 |
| 4,643,073 | A * | 2/1987 | Johnson | F41A 21/36 89/14.3 |
| 4,685,534 | A * | 8/1987 | Burstein | F01N 1/00 181/223 |
| 5,078,043 | A | 1/1992 | Stephens | |
| 7,207,258 | B1 * | 4/2007 | Scanlon | F41A 21/30 181/223 |
| 8,387,299 | B1 | 3/2013 | Brittingham et al. | |
| 8,485,082 | B1 * | 7/2013 | Masaki | F41A 21/36 89/14.3 |
| 9,102,010 | B2 | 8/2015 | Wilson | |
| 9,599,421 | B1 | 3/2017 | Dean | |
| 9,851,166 | B2 | 12/2017 | Petersen | |
| 10,126,084 | B1 | 11/2018 | Oglesby | |
| 10,753,699 | B2 * | 8/2020 | Klett | F41A 21/30 |
| 2007/0284178 | A1 * | 12/2007 | Scanlon | F41A 21/30 180/309 |
| 2010/0282056 | A1 * | 11/2010 | Hung | F41A 21/34 89/14.2 |
| 2011/0186377 | A1 | 8/2011 | Kline et al. | |
| 2014/0216237 | A1 * | 8/2014 | Butler | F41A 21/36 89/14.4 |
| 2015/0276340 | A1 | 10/2015 | Vais | |
| 2016/0061551 | A1 | 3/2016 | Petersen | |
| 2016/0123689 | A1 * | 5/2016 | Maeda | F41A 21/36 89/14.3 |
| 2016/0161203 | A1 | 6/2016 | Wilson | |
| 2017/0205175 | A1 | 7/2017 | Garst et al. | |
| 2018/0135932 | A1 | 5/2018 | Tomczak | |
| 2019/0257607 | A1 * | 8/2019 | Dobrinescu | F41A 21/30 |
| 2020/0232741 | A1 * | 7/2020 | Hood, II | F41A 21/30 |
| 2021/0071979 | A1 * | 3/2021 | Plunkett, Jr. | F41A 21/30 |
| 2021/0254921 | A1 * | 8/2021 | Spector | F41A 21/34 |

FOREIGN PATENT DOCUMENTS

| | | | |
|---|---|---|---|
| FR | 858032 | A | 11/1940 |
| WO | 2014076357 | A1 | 5/2014 |

* cited by examiner

MULTI-BAFFLED FIREARM SUPPRESSOR

CROSS REFERENCE TO RELATED APPLICATIONS

The present application is a continuation of U.S. patent application Ser. No. 16/600,379 titled "MULTI-BAFFLED FIREARM SUPPRESSOR", and filed on Oct. 11, 2019. Application Ser. No. 16/600,379 is a continuation-in-part of U.S. patent application Ser. No. 15/904,218 titled "MULTI-BAFFLED FIREARM SUPPRESSOR," and filed on Feb. 23, 2018, now issued as U.S. Pat. No. 10,619,963. U.S. patent application Ser. No. 15/904,218 claims priority to U.S. Provisional Application No. 62/482,621, titled "MULTIBAFFLED FIREARM SUPPRESSOR," and filed on Apr. 6, 2017. The entire contents of each of the above-referenced applications are hereby incorporated by reference for all purposes.

FIELD

Embodiments of the subject matter disclosed herein relate to firearm sound suppressors and, more particularly to employing a plurality of baffles in a firearm sound suppressor.

BACKGROUND

Firearms utilize high pressure exhaust gasses to accelerate a projectile such as a bullet. Firearm silencers (hereafter referred to as "suppressors") are typically added to the muzzle (exhaust) of a firearm to capture the high pressure exhaust gasses of a given firearm. These high pressure exhaust gasses are the product of burning nitrocellulose and possess significant energy that is used to accelerate the projectile. The typical exhaust gas pressure of a rifle cartridge in a full length barrel may be in the range of 7-10Ksi. A short barreled rifle may have exhaust gas pressures in the 10-20Ksi range. Moving at supersonic speeds through the bore, the exhaust gasses provide the energy to launch the projectile and also result in the emanation of high-decibel noises typically associated with the discharge of firearms. When in action, firearm suppressors lower the kinetic energy and pressure of the propellant gasses and thereby reduce the decibel level of the resultant noises.

Firearms suppressors are mechanical pressure reduction devices that contain a center through-hole to allow passage of the projectile. Suppressor design(s) utilize static geometry to induce pressure loss across the device by means that may include rapid expansion and contraction, minor losses related to inlet and outlet geometry, and induced pressure differential to divert linear flow.

Suppressors can be thought of as "in-line" pressure reduction devices that capture and release the high pressure gasses over a time (T). Typical suppressor design approaches used to optimize firearms noise reduction include maximizing internal volume, and providing a baffled or "tortured" pathway for propellant gas egress. Each of these approaches must be balanced against the need for clear egress of the projectile, market demand for small overall suppressor size, adverse impacts on the firearms performance, and constraints related to the firearms original mechanical design.

Baffle structures within a suppressor provide the "tortured" pathways which act to restrain the flow of propellant gasses and thereby reduce the energy signature of said gasses. As a result of this function the baffle structures in a suppressor are typically the portion of a suppressor that absorbs the most heat from propellant gasses during firing. The "mirage" effect is distortion of the sight picture caused by hot air rising off of the hot suppressor directly in front of the aiming optic on the firearm. The "mirage" effect is a well know negative aspect of using a suppressor with a firearm, and is often mitigated by wrapping the suppressor in an insulating wrap.

The inventors herein have recognized significant issues, such as the "mirage" effect, related to excess heat build-up that may arise due to the use of a suppressor on a firearm. In the current invention a plurality of baffled gas exhaust tubes, each of which reside in their own internal tube, are employed to reduce the pressure of the propellant gasses. To mitigate the issues related to excess heat build-up the baffled exhaust tubes are positioned such that the tubes are not tangent with (touching) an interior surface of the outer wall or each other. The plurality of baffled exhaust gas tubes are instead contained within fluted spiral structures that follow a rifling pattern about a central axis along the longitudinal length of the suppressor's inner body wall. In at least one example, these tubes may be non-coaxial tubes relative to the central axis of the suppressor. Moreover, these tubes may be spaced away from an interior surface of the suppressor's inner body wall and these tubes may not contact the interior surface of the suppressor's inner body wall.

The inventors herein have recognized that this positioning maximizes the surface area of the plurality of baffled exhaust gas tubes inside the suppressor body to maximize thermal transmission between the hot exhaust gases and the suppressor body. This positioning further helps to more evenly distribute the heat energy of the hot exhaust gases to the interior structures of the suppressor body such that "hot spots" are minimized. In addition, the positioning minimizes the thermal transmission between the internal baffled exhaust gas tubes and the outer wall; a lumen defined by the area between the inner surface of the suppressors' outer wall and the outer walls of the baffled exhaust gas tubes creates a thermal buffer. As a result, thermal transmission from the high heat area of the baffled exhaust tubes to the outside wall is minimized. By delaying the heating of the suppressors' outer wall, the "mirage" effect to the shooter is delayed, allowing the operator to shoot more cartridges before the "mirage" effect occludes the view through the optic.

Autoloading firearms, both semi-automatic and automatic, are designed to utilize a portion of the waste exhaust gasses to operate the mechanical action of the firearms. When in operation the mechanical action of the firearm automatically ejects the spent cartridge case and emplaces a new cartridge case into the chamber of the firearms barrel. One typical autoloading design taps and utilizes exhaust gasses from a point along the firearms barrel. The tapped gasses provide pressure against the face of a piston, which in turn triggers the mechanical autoloading action of the firearm. The energy of the tapped exhaust gasses supplies the work required to operate the mechanical piston of the firearm enabling rapid cycling of cartridges.

The inventors herein have recognized significant issues arising when suppressors are employed on autoloading firearms. As an example, use of a suppressor may result in sustained elevated internal pressures which result in transmission of excess work energy to the piston during the course of operation. When use of a suppressor results in such a build-up of pressure in the firearms chamber over an extended time (T), the excess work energy may lead to opening of the breech (chamber) sooner than is supported by the original firearms design. Therefore, as recognized by the inventors herein, overcoming this issue requires achieving the desired pressure loss (ΔP) over an abbreviated time (T) such that the internal pressure returns below the pressure threshold of the piston before firing of the subsequent cartridge. As a second example, use of a suppressor on autoloading firearms may result in excess venting of exhaust gasses at the rear of the weapon in the direction of the operator. Excess venting of exhaust gasses at the rear of the weapon is undesirable as the gasses may contain toxic substances, and the particulate matter in the gasses may foul the weapons chamber.

In one embodiment, the issues described above may be addressed by a suppressor comprising a geometric baffle system and further comprising an auxiliary system of a plurality of baffled exhaust gas tubes that may achieve the desired pressure loss (ΔP) over an abbreviated time period (ΔT). The suppressor may be of a unitary design generated by 3D printing. In another embodiment, the issues described above may be addressed by a suppressor comprising a plurality of exhaust vents that efficiently direct the exhaust gasses outward through the front of the suppressor and away from the operator and the firearm. By reducing the time required for the internal pressure of suppressor, chamber, and barrel to return to ambient pressure conditions, by time $T_x$, mechanical malfunction of the autoloading mechanism may be avoided. Further, reducing the internal pressure in the suppressor over an abbreviated time period reduces the pressure inside the barrel and chamber, thereby eliminating excess venting of exhaust gasses at the rear of the firearm in the direction of the operator.

The auxiliary baffled exhaust tubes may exit in any direction. Exiting out the front of the suppressor was chosen as this was the direction opposite the operator. There could be a scenario where this is suboptimal and other directions would be considered. For example, it may be desirable to have the exhaust gasses exit out of the side of the suppressor or on only one side to minimize exhaust gas occluding sensors on remote weapon platforms.

In this way, the firearm suppressor may be operable on any type of autoloading firearms, including but not limited to machine gun applications, without adversely affecting mechanical operations according to the original firearms design. Further, the firearm suppressor may be operable without adversely impacting the safety or performance of the operator. The utility of the suppressor may therefore be extended and more fully realized. Other elements of the disclosed embodiments of the present subject matter are provided in detail herein.

In another embodiment, the suppressor may be operatively configured to be attached to a firearm. The suppressor may include a tubular housing body defining a longitudinal or central axis, wherein the baffle sections and further wherein the spiral fluting sections and further wherein the auxiliary system of baffled exhaust gas tubes of the suppressor are integrated and encased within a parent tubular housing component. In this way, the interior baffle section(s) may be surrounded by a housing such that the efficiency and efficacy of the suppressor are maintained.

The tubular housing body may further comprise a projectile entrance portion and a projectile exit portion disposed at a longitudinally rearward region and a longitudinally forward region, respectively. The rearward end of the suppressor may have an opening sufficiently large enough to permit passage of at least a portion of a firearm barrel, where the suppressor may attach via connectable interaction devices such as interlacing threads.

It should be understood that the summary above is provided to introduce in simplified form, a selection of concepts that are further described in the detailed description. It is not meant to identify key or essential features of the subject matter. Furthermore, the disclosed subject matter is not limited to implementations that solve any disadvantages noted above or in any part of this disclosure.

The above drawings are to scale, although other relative dimensions may be used, if desired. The drawings may depict components directly touching one another and in direct contact with one another and/or adjacent to one another, although such positional relationships may be modified, if desired. Further, the drawings may show components spaced away from one another without intervening components therebetween, although such relationships again, could be modified, if desired.

DETAILED DESCRIPTION

An example multi-baffled firearm suppressor is described herein. The following description relates to various embodiments of the sound suppressor as well as methods of manufacturing and using the device. Potential advantages of one or more of the example approaches described herein relate to reducing a time required for the suppressor to return to ambient pressure without adversely impacting performance of the firearm, reducing a mirage effect, improving thermal signature reduction characteristics, improving operating performance with autoloading firearms, eliminating rearward venting of exhaust gasses during use with semi-automatic weapon and various others as explained herein.

Figure 1:
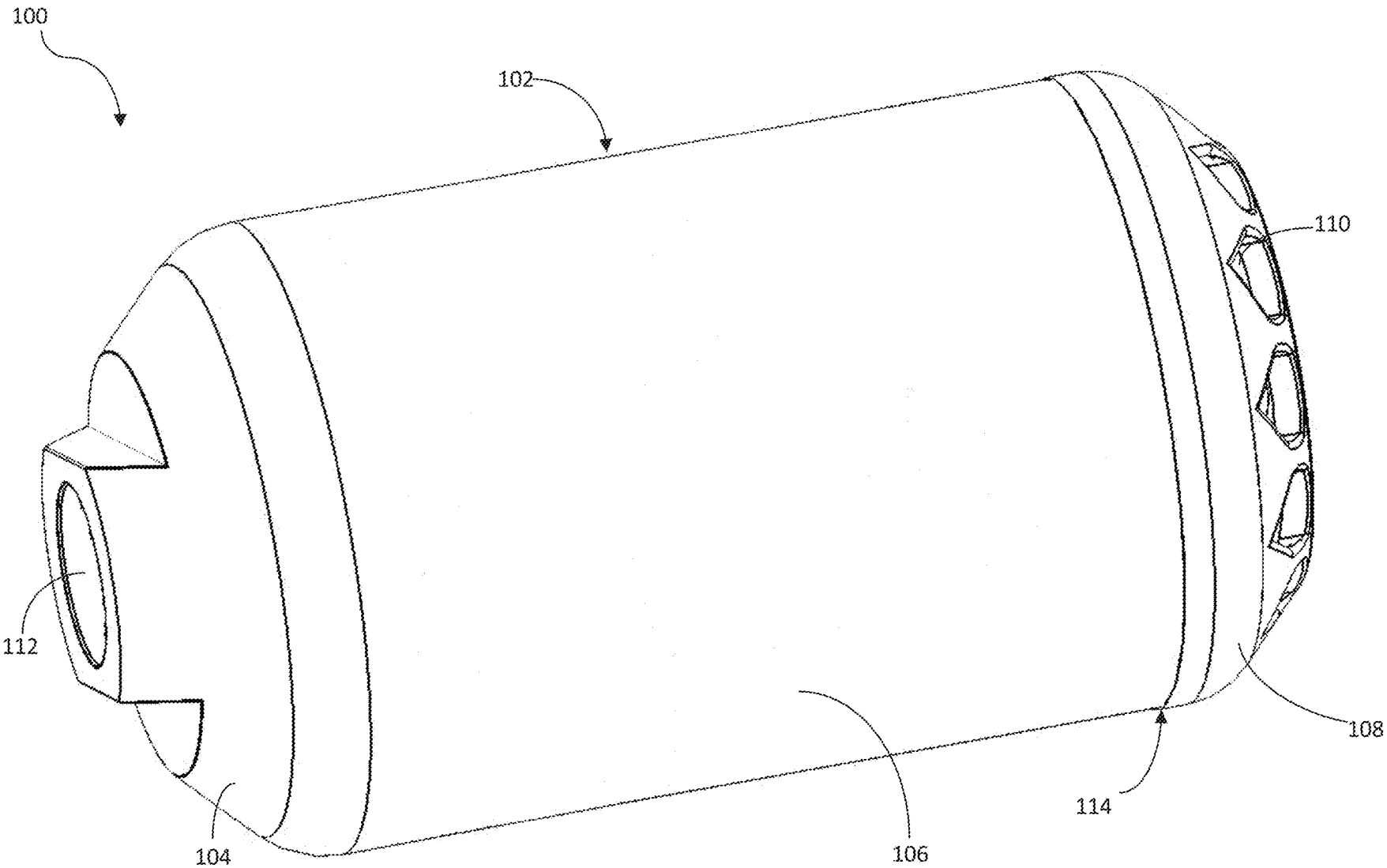
FIG. 1 is a wireframe view of an example suppressor assembly with elongate tubular housing, exhaust gas venting ports, and muzzle attachment, according to at least one embodiment of the present disclosure.
Figure 4:
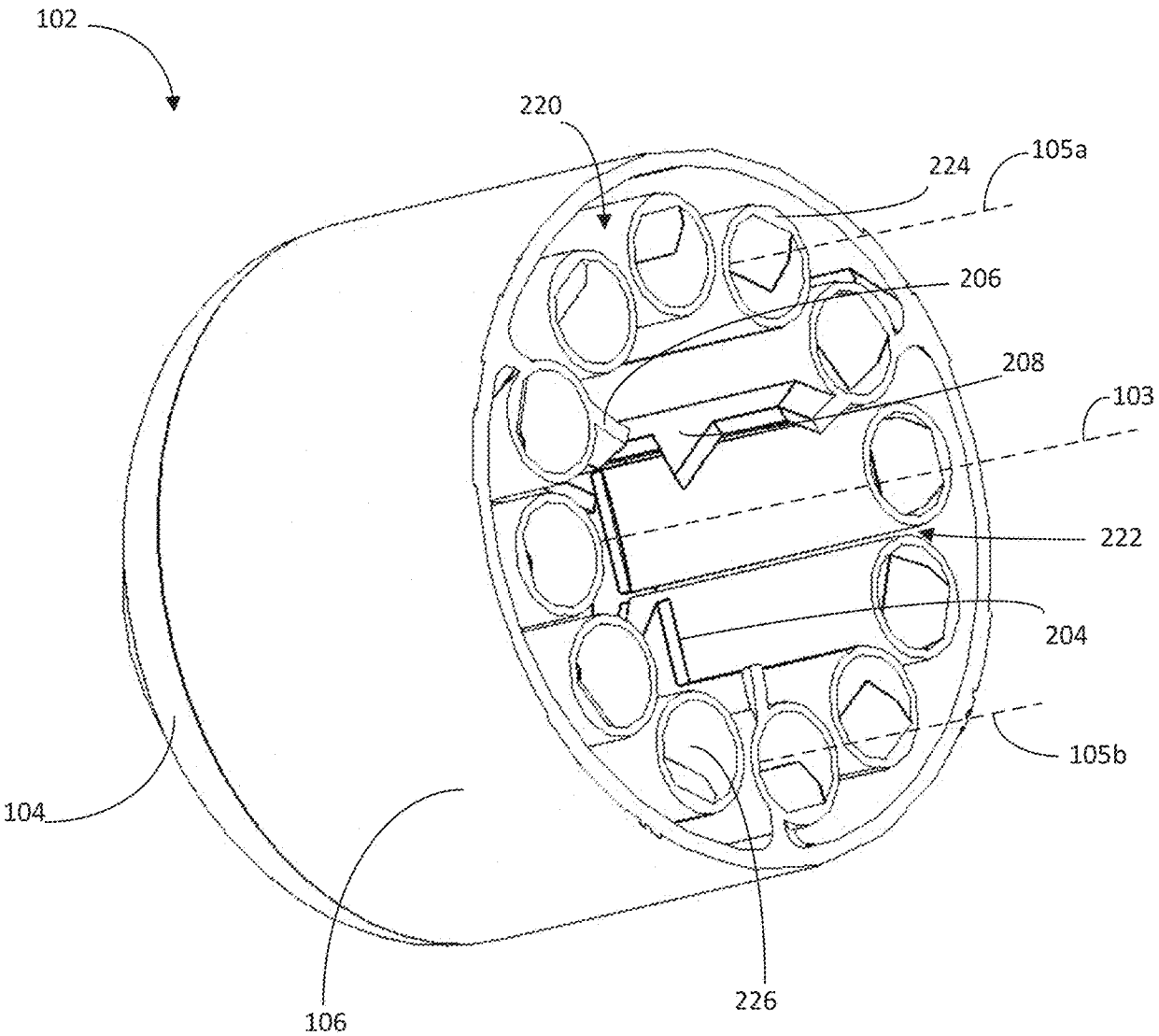
FIG. 4 is a cross-cut view of the elongate tubular housing illustrating the plurality of exhaust gas baffle tubes, according to at least one embodiment of the present disclosure.
Figure 5:
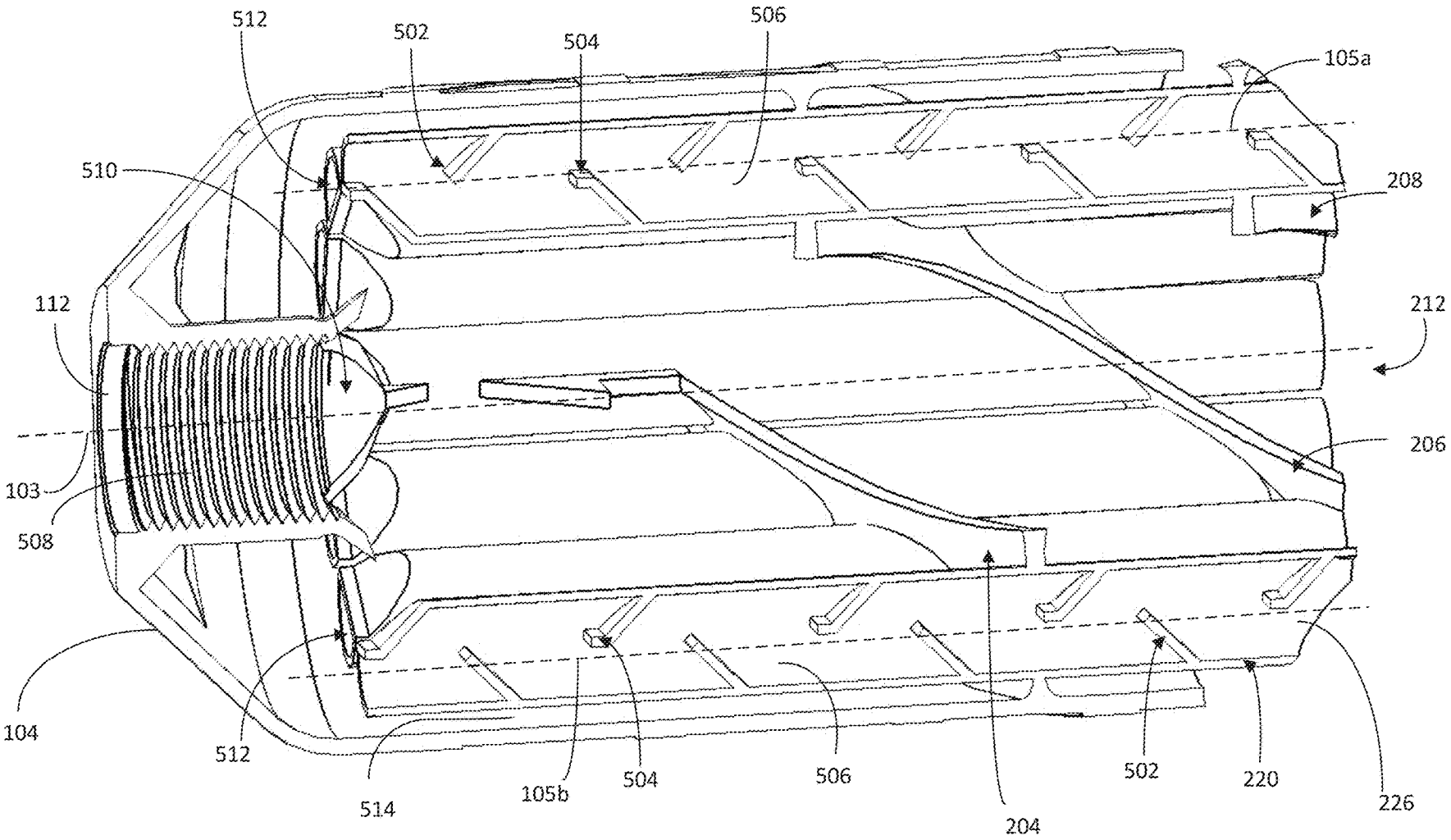
FIG. 5 is a cross-sectional cutaway view of the elongate tubular housing illustrating the interior of sample exhaust gas baffle tubes, according to at least one embodiment of the present disclosure.
Figure 14:
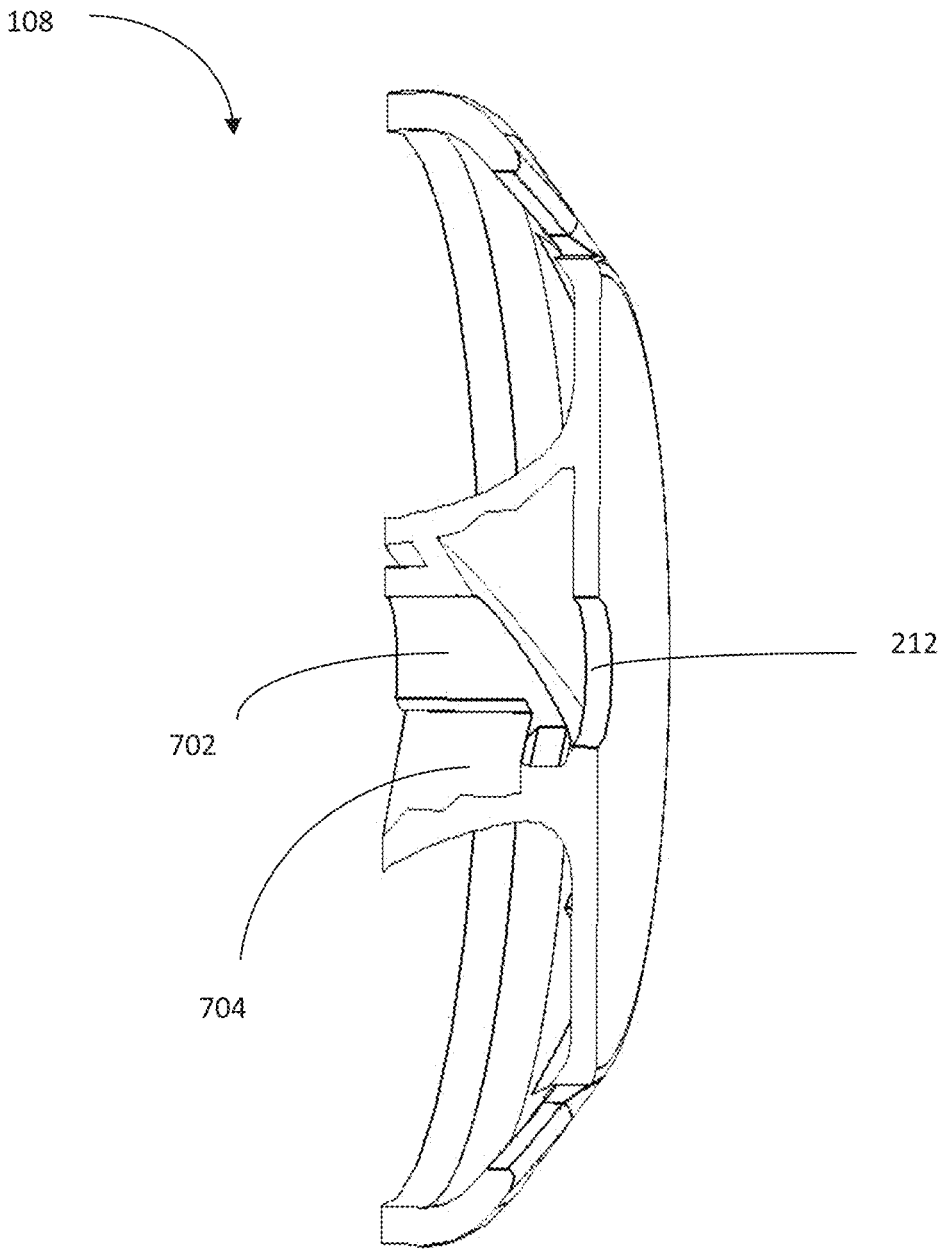
FIG. 14 is a cross-sectional cutaway view of FIG. 13.

The multi-baffled firearm suppressor may be coupled to a firearm, as described at FIGS. 1, 5 & 14. In at least one embodiment, the multi-baffled firearm suppressor may comprise a system of a plurality of baffled exhaust tubes as shown at FIGS. 2-5, FIGS. 15-18, and FIG. 22. These baffled exhaust tubes may be advantageous for suppressing the overall signatures of the firearm by minimizing the time required for the system to return to ambient pressure, while also maximizing the surface area of structures inside the suppressor, and further minimizing thermal transmission between the internal structures and the outer wall of the tubular housing.

Further, FIGS. 1-22 show the relative positioning of various components of the suppressor assembly. If shown directly contacting each other, or directly coupled, then such components may be referred to as directly contacting or directly coupled, respectively, at least in one example. Similarly, components shown contiguous or adjacent to one another may be contiguous or adjacent to each other, respectively, at least in one example. As an example, components lying in face-sharing contact with each other may be referred to as in face-sharing contact or physically contacting one another. As another example, elements positioned apart from each other with only a space there-between and no other components may be referred to as such, in at least one example.

As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being triangular, helical, straight, planar, curved, rounded, spiral, angled, or the like). Further, elements shown intersecting one another may be referred to as intersecting elements or intersecting one another, in at least one example. Further still, an element shown within another element or shown outside of another element may be referred as such, in one example. For purpose of discussion, FIGS. 1-22 will be described collectively.

Referring now to FIG. 1, an exterior view of a first example suppressor assembly 100 according to one or more embodiments of the current disclosure is shown. The exterior view of the suppressor assembly 100 is shown in order to illustrate the overall shape of the suppressor and relative spatial positioning. As shown in the figure, the suppressor assembly 100 may comprise an elongate tubular housing 102, a rearward region 104, an outer surface 106, a forward region 108, a plurality of exhaust gas venting ports 110, projectile entrance passage 112, and junction 114.

The suppressor of FIG. 1 may comprise a projectile entrance passage 112 forming a generally annular channel at the rearward region 104 wherethrough a projectile such as a bullet may enter to pass through and exit the suppressor 100 at the forward region 108.

The junction 114 is the circumferential area of the suppressor 100 where the elongate tubular housing 102 and helical baffle assembly 200, which is described in detail below, join together. The forward region 108 tapers from the junction 114 toward the forward most region of the assembly at an approximate 45 degree angle. The forward region 108 then abruptly flattens out forward of the exhaust gas venting ports 110. The plurality of exhaust gas venting ports 110 are triangular shaped openings, positioned circumferentially within the forward region 108, midway between the junction 114 and the forward most end of the suppressor 100.

The longitudinally rearward region 104 contains the projectile entrance passage 112, an opening sufficiently large enough to permit passage of at least a portion of a firearm barrel, where the suppressor 100 may attach via connectable interaction devices such as interlacing threads.

Figure 2:
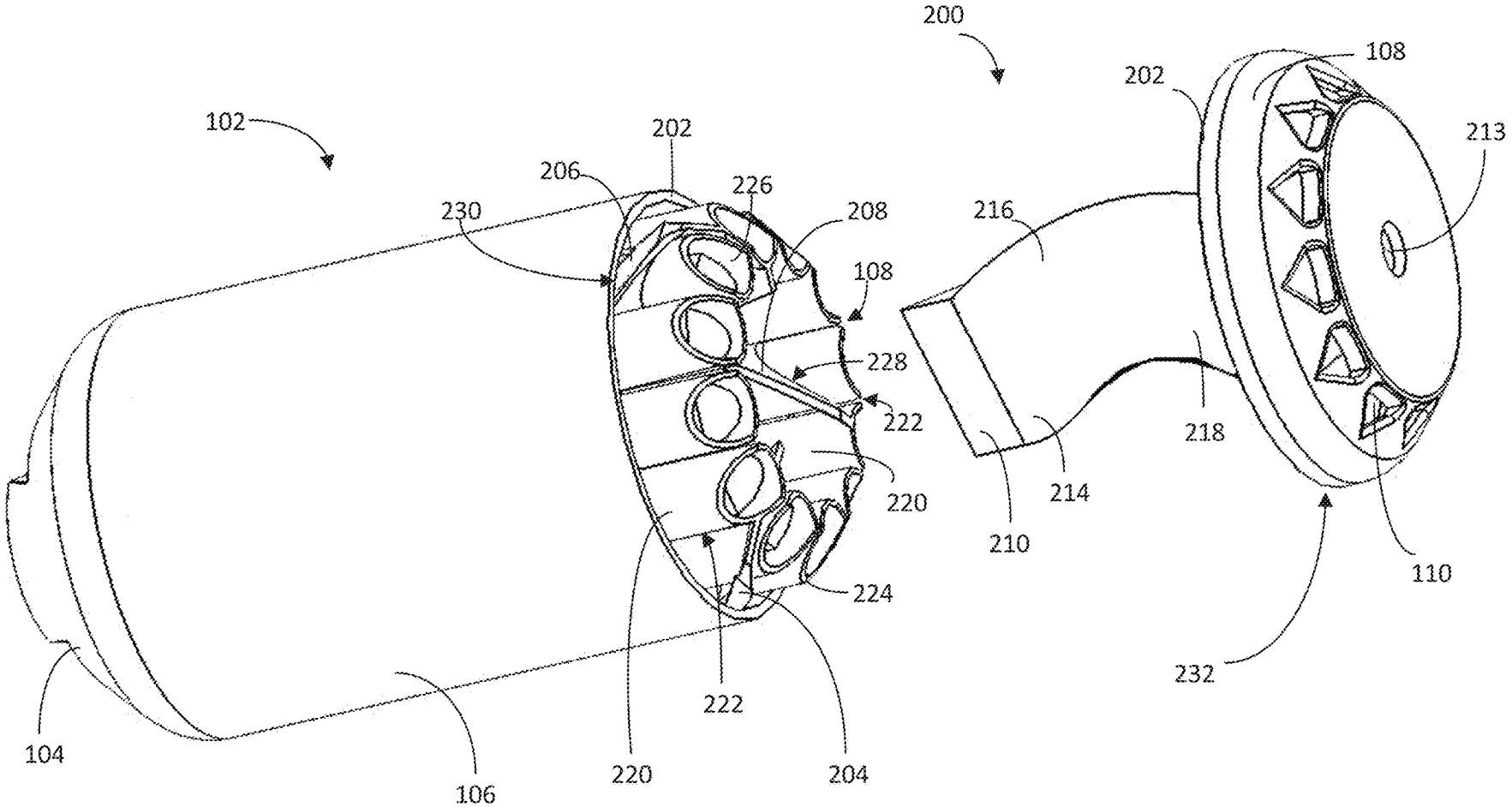
FIG. 2 is a wireframe view illustrating the elongate tubular housing and the helical baffle section of the suppressor assembly separate from one another, according to at least one embodiment of the present disclosure.

Turning now to FIG. 2, FIG. 2 shows a view of a second example suppressor assembly according to one or more embodiments of the present disclosure, where an elongate tubular housing 102 and a helical baffle assembly 200 of the example suppressor assembly 100 are shown separated from one another for viewing purposes. As shown in the figure, the elongate tubular housing 102 may comprise a plurality of baffle tubes 220, baffle tube exit passages 226, a junction 202, first spiral flute section 204, second spiral flute section 206, and third spiral flute section 208. The figure further illustrates the helical baffle assembly 200 which may comprise a junction 202, projectile exit passage 212, first baffle section 214, second baffle section 216, third baffle section 218, and forward region 108 which contains the plurality of exhaust gas venting ports 110. It is noted that baffle tubes 220 may also be referred to as baffle ducts herein.

The helical triangular nature of the baffle assembly 200 as well as the triangular helical nature of each baffle assembly component is shown in FIG. 2. The helical triangular nature of the baffle assembly 200 as well as the triangular helical nature of each baffle assembly component is shown in FIG. 2.

The figure illustrates the manner in which the spiral flute sections 204, 206 and 208 follow a rifling pattern about a central axis along the longitudinal length of the suppressors' inner body wall. Further, the figure illustrates the junction 230 where the spiral fluting sections are tangent with the suppressors' inner wall.

FIG. 2 illustrates in some embodiments the manner in which the plurality of baffle tubes 220 are positioned non-tangentially away from the inner wall of the tubular housing 102 and contained within the spiral fluted sections 204, 206 and 208. As may be seen in the example shown in FIG. 2, these baffle tubes 220 are arranged non-coaxially relative to a central axis of the elongate tubular housing 102.

The relative positioning of the baffle tubes 220 away from the inner wall thereby forms a lumen defined by the inner wall of the tubular housing 102 and the outer walls of the baffle tubes 220 and spiral fluted sections 204, 206 and 208. This lumen provides a thermal barrier between the baffle tubes 220 and outer wall of the tubular housing 102. Further, this lumen provides a non-baffled cavity which, due to the shaping of the spiral fluting sections, directs excess exhaust gasses forward through the suppressor in a rifling pattern toward the exhaust gas venting ports 110.

As the exhaust gas baffle tubes 220 do not provide egress for the projectile, their shape and internal structure is extremely flexible and may include other shapes and provide other directions for exhaust gas egress not illustrated. Exiting of exhaust gasses out through the forward region 108 of the suppressor 100 was chosen as this was the direction opposite the operator. There could be other scenarios where this would be suboptimal and other exit directions, such as the side(s) of the suppressor, could be designed.

The structure and positioning of the plurality of baffle tubes 220 are critical for the overall performance of the suppressor 100 in restraining and absorbing energy of the propellant gasses. The combined auxiliary baffle tubes 220 provide a significant reduction in the overall mass flow rate of the exhaust gasses and therefore a reduction of the overall energy signatures of the firearm. Further, the positioning of the baffle tubes 220 enables heat transmission from the exhaust gasses to the interior body of the suppressor, and minimizes heat transmission to the outer walls of the suppressor 100.

FIG. 2 further illustrates that in some embodiments the exhaust gas venting ports 110 are further positioned forward of and aligned over the baffle tube exit passages 226. Positioning and shaping of the exhaust venting ports 110 is critical so as to facilitate rapid and efficient movement of exhaust gasses forward through, out and away from the suppressor body.

In some embodiments, the housing may be manufactured via processes including but not limited to, 3-D printing (e.g. selective laser melting (SLM), fused deposition modeling (FDM), sterolithography (SLA) and laminated object manufacturing (LOM)), casting, molding, and additive manufacturing.

The tubular housing 102 may be coupled with the helical baffle assembly 200 to form a suppressor assembly. Further, in some embodiments, the elongate tubular housing 102 and the baffle assembly 200 may be formed together such that a unitary, uninterrupted, and contiguous surface is achieved. In at least one example, the tubular housing 102 may be removably coupled with the helical baffle assembly 200 to form a suppressor assembly. However, in other examples, the tubular housing 102 may be permanently formed with the helical baffle assembly 200 to form a suppressor assembly. For example, the helical baffle assembly 200 and the tubular housing 102 may be welded to one another to form a permanent connection between the helical baffle assembly 200 and the tubular housing 102. In other examples, the helical baffle assembly 200 and the tubular housing 102 may be formed integrally in a single piece via additive manufacturing such as 3D printing, for example.

The helical baffle assembly 200 may comprise a projectile exit opening 213 for passage of a projectile traveling through the suppressor assembly during a firing event, for example. The helical baffle assembly 200 may further include one or more exhaust gas venting ports 110 positioned about a circumference of the helical baffle assembly 200.

Figure 3:
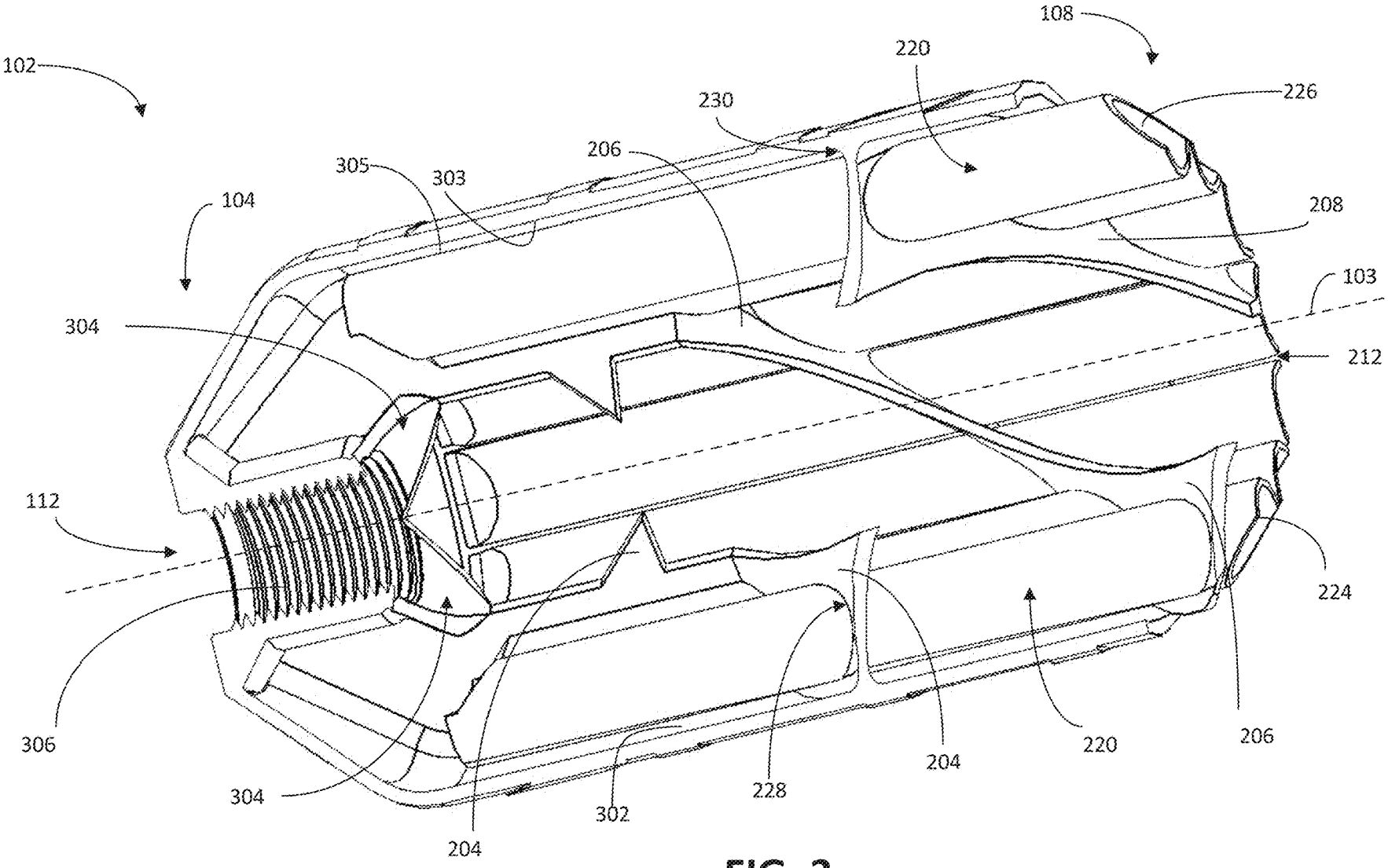
FIG. 3 is a wireframe view illustrating a cross-sectional cutaway view of the elongate tubular housing, according to at least one embodiment of the present disclosure.

Turning now to FIG. 3, in FIG. 3 a cross-sectional view of the elongate tubular housing 102 is shown for viewing purposes. As may be seen in FIG. 3, lumen 302 is formed between an exterior surface 305 of the baffle tubes 220 and an interior surface 303 of the elongate tubular housing 102 for a majority of a length of the baffle tubes 220. As discussed above, exhaust gas may be flowed through the baffle tubes 220.

As also may be seen in FIG. 3, flared projection 304, threads 306, plurality of exhaust gas baffle tubes 220, and helical fluting sections 204, 206 and 208 may be seen positioned within the elongate tubular housing 102 of FIG. 3. These helical fluting sections 204, 206, 208 may be positioned between a portion of the baffle tubes 220 and the inner surface of the elongate tubular housing. For example, as shown in FIG. 3, the exhaust gas baffle tubes 220 may be positioned within a helical fluted section 204, 206, 208. The helical fluting sections 204, 206, 208 may further surround a projectile path through the elongate tubular housing 102, in at least one example.

A projectile, such as a bullet, may pass through projectile entrance passage 112, where the projectile entrance passage 112 is positioned at a rearward region 104 of the elongate tubular housing 102. The projectile may then pass along a length of the elongate tubular housing and exit via exit passage 212. A path through which the projectile travels within the elongate housing 102 may be approximately along a central axis 103 of the elongate tubular passage, and the helical fluting sections 204, 206, 208 may surround the path through which the projectile travels.

Exhaust gas from the combustion event propelling the projectile through the projectile entrance 112, may be flowed at least in part through one or more of the baffle tubes 220. By flowing the exhaust gas through one or more of the baffle tubes 220, which are spaced away from the interior surface of the elongate tubular housing 102, a mirage effect that may typically occur with the firearm may be prevented. In particular, the baffle tubes 220 may not contact the interior surface 303 of the elongate tubular housing 102, thus reducing an amount of heat transfer from the exhaust gas to the elongate tubular housing 102 and reducing a mirage effect. Moreover, the baffle tubes 220, as well as the helical fluting sections 204, 206, 208 may effectively reduce a sound produced by the combustion.

FIG. 4 illustrates a cross-cut view of the elongate tubular housing 102 which more clearly shows the interior of the suppressor. In the embodiment shown in FIG. 4 the plurality of exhaust gas baffle tubes 220 is clearly visible. Each of the exhaust gas baffle tubes 220 shown in the embodiment illustrated are clearly not tangent with each other, located away from the inner wall of the tubular housing 102, and encased within the spiral fluted sections 204, 206, and 208. Furthermore, as shown in FIG. 4, the baffle tubes 220 are arranged non-coaxially relative to a central axis 103 of the elongate tubular housing 102. Moreover, a central axis 105*a*, 105*b* of each of the baffle tubes 220 is approximately parallel to the central axis 103 of the elongate tubular housing 102.

In FIG. 5, a cross-sectional view of the elongate tubular housing 102 similar to FIG. 3 is shown. In the figure the exterior baffle tube projections 502, and angled baffle tube projections 504 are visible inside the cut-away of the sample exhaust gas baffle tubes 220. As shown in FIG. 5, an end of the angled tube projections most proximal to the central axis 105*a*, 105*b* of the baffle tube 220 within which the angled tube projection 504 is positioned is substantially parallel to this central axis. Moreover, all of the exterior baffle tube projections 502 and angled baffle tube projections 504 extend towards the central axis 105*a*, 105*b* of the baffle tubes 220 within which they are positioned. The figure also illustrates the baffle tube lumen 506, threads 508, flared projections 510, baffle tube entrance 512, as well as the lumen 514 defined by the inner wall of the suppressor and outer walls of the baffle tubes 220.

Figure 6:
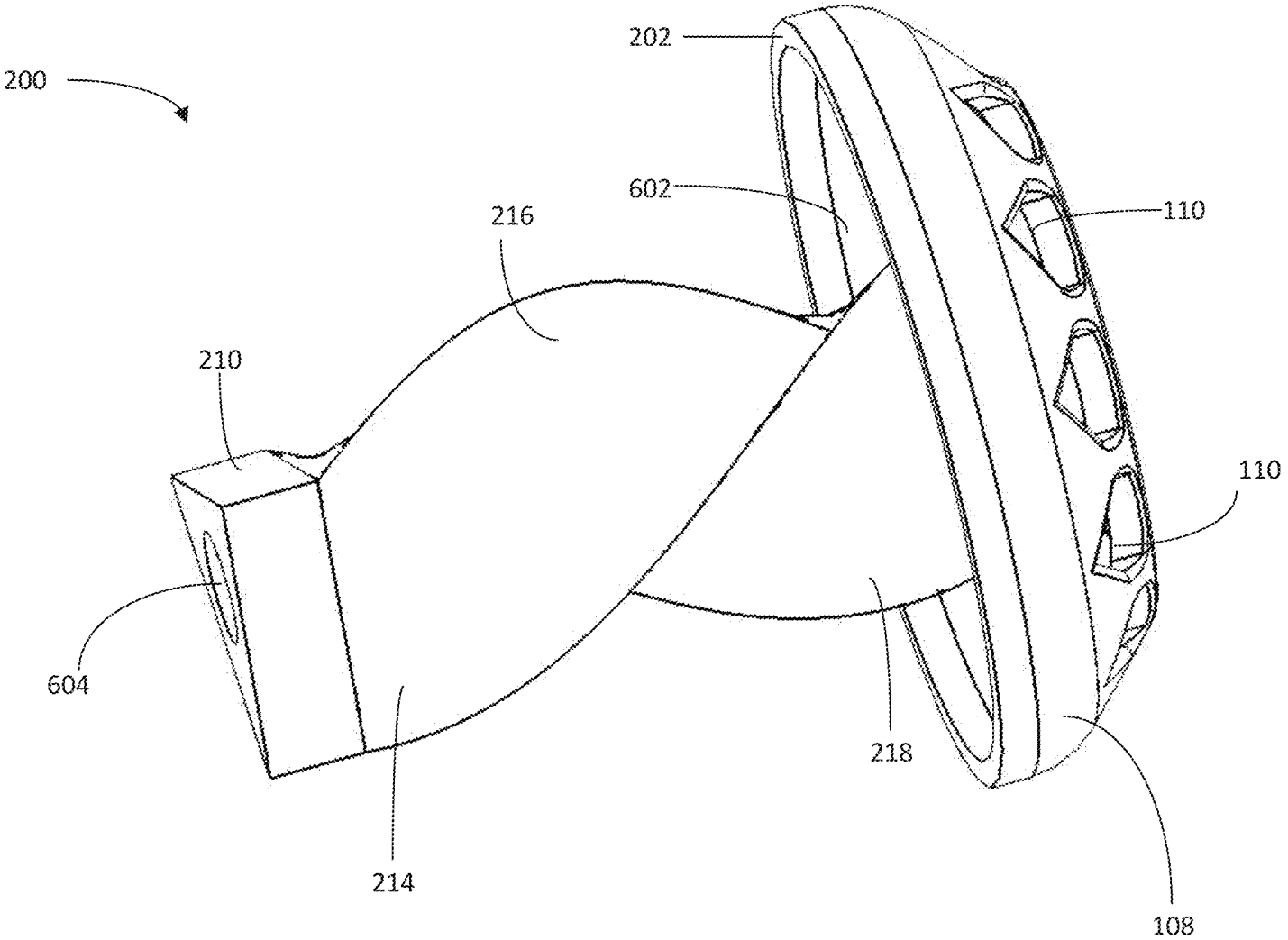
FIG. 6 is an enlarged perspective view of the helical baffle section assembly, according to at least one embodiment of the present disclosure.

In FIG. 6, an enlarged perspective view of the helical baffle assembly 200 is provided. As discussed in FIG. 2, the helical baffle assembly 200 may comprise a first baffle section 214, second baffle section 216, and third baffle section 218. The helical triangular nature of the baffle assembly 200 as well as the triangular helical nature of each baffle assembly component is shown in FIG. 6. The figure further illustrates the inner surface 602 of the endcap. When a projectile enters the baffle assembly via circular hole 604 at the rearward face of the first baffle section 214, the projectile may travel through the baffle assembly.

Figure 7:
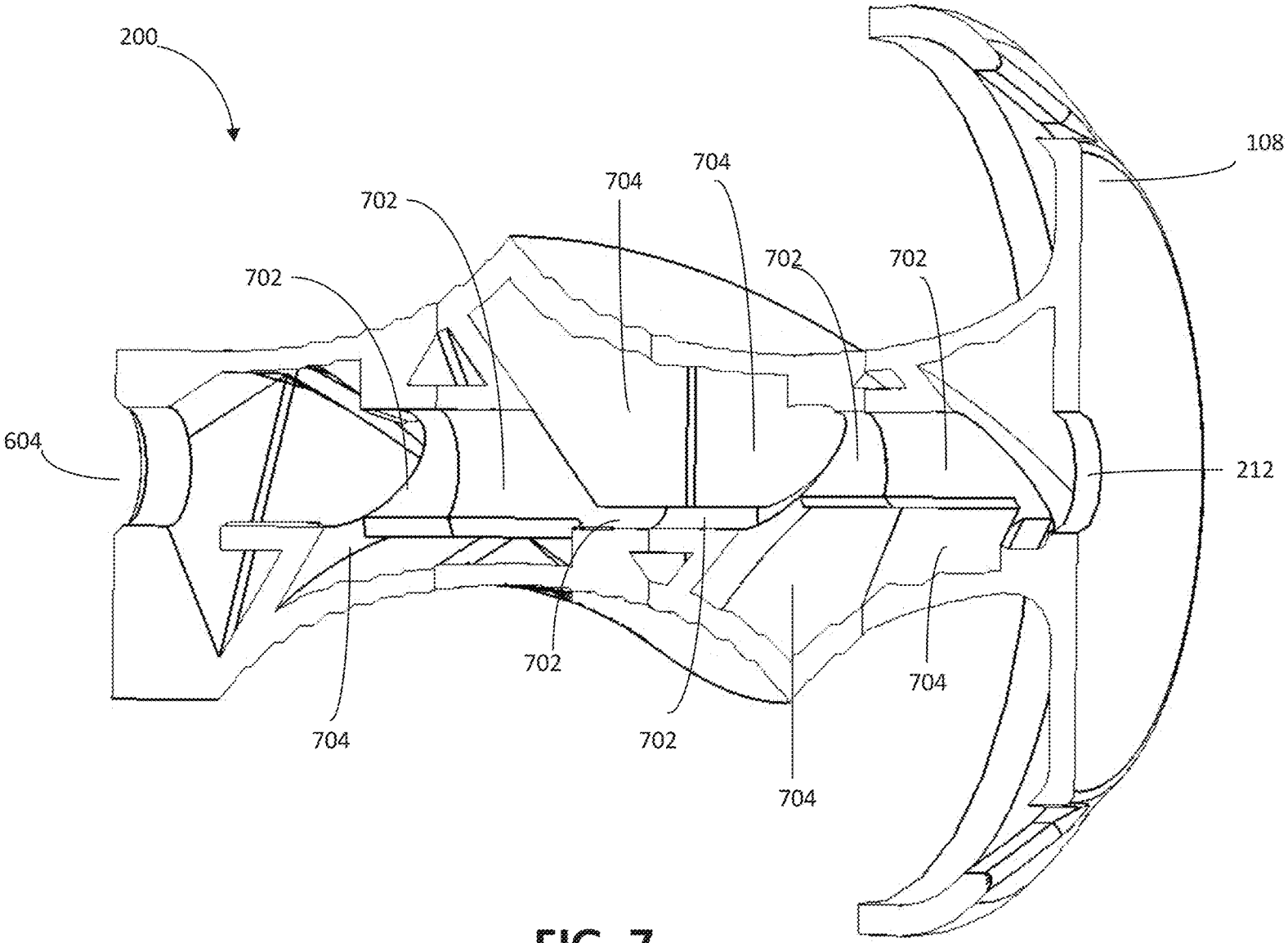
FIG. 7 is a cross-sectional cutaway view of FIG. 6.

In FIG. 7, a cross-sectional cut-away view of FIG. 6 is provided. In this view the interior components of the helical baffle assembly 200 are more clearly visible. In this representation, it may be seen that the u-shaped grooves 702 are staggered such that they do not line up and coincide with one another. This staggering of grooves that may act as guidance or support grooves in one embodiment may allow for enhanced dispersal and/or dissipation of propellant gases. The u-shaped grooves may be disposed axially along a central axis of the suppressor and may be disposed longitudinally behind a forward projectile exit passage 212. The exit passage 212 may be disposed within the center of a front face of the forward baffle section, the front face may further define a forward region 108 of the suppressor 100.

Figure 8:
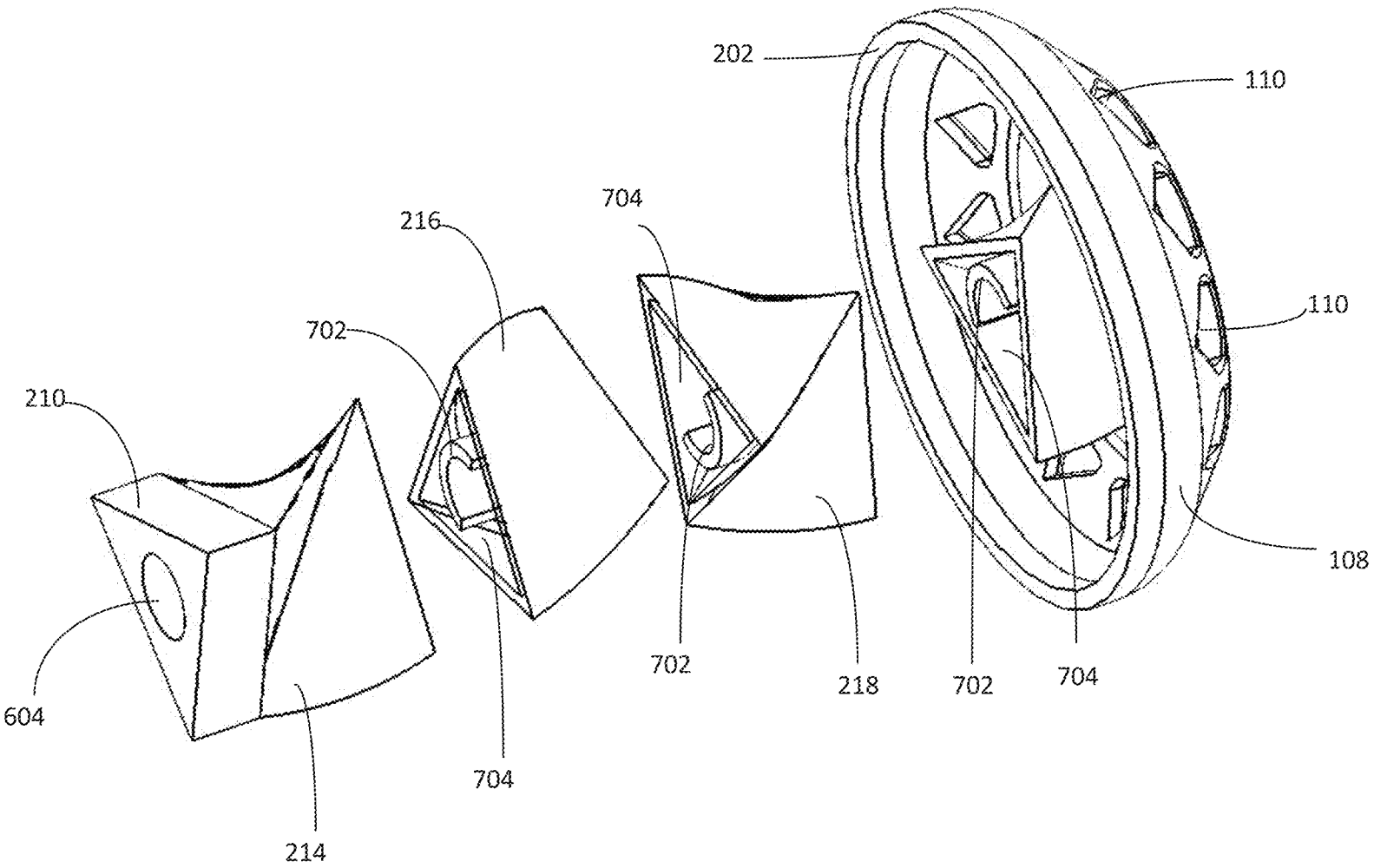
FIG. 8 is an enlarged perspective view of the helical baffle section assembly separated into its component pieces, according to at least one embodiment of the present disclosure.

Turning to FIG. 8, an exploded view of the components of the helical baffle assembly 200 is provided.

Figure 9:
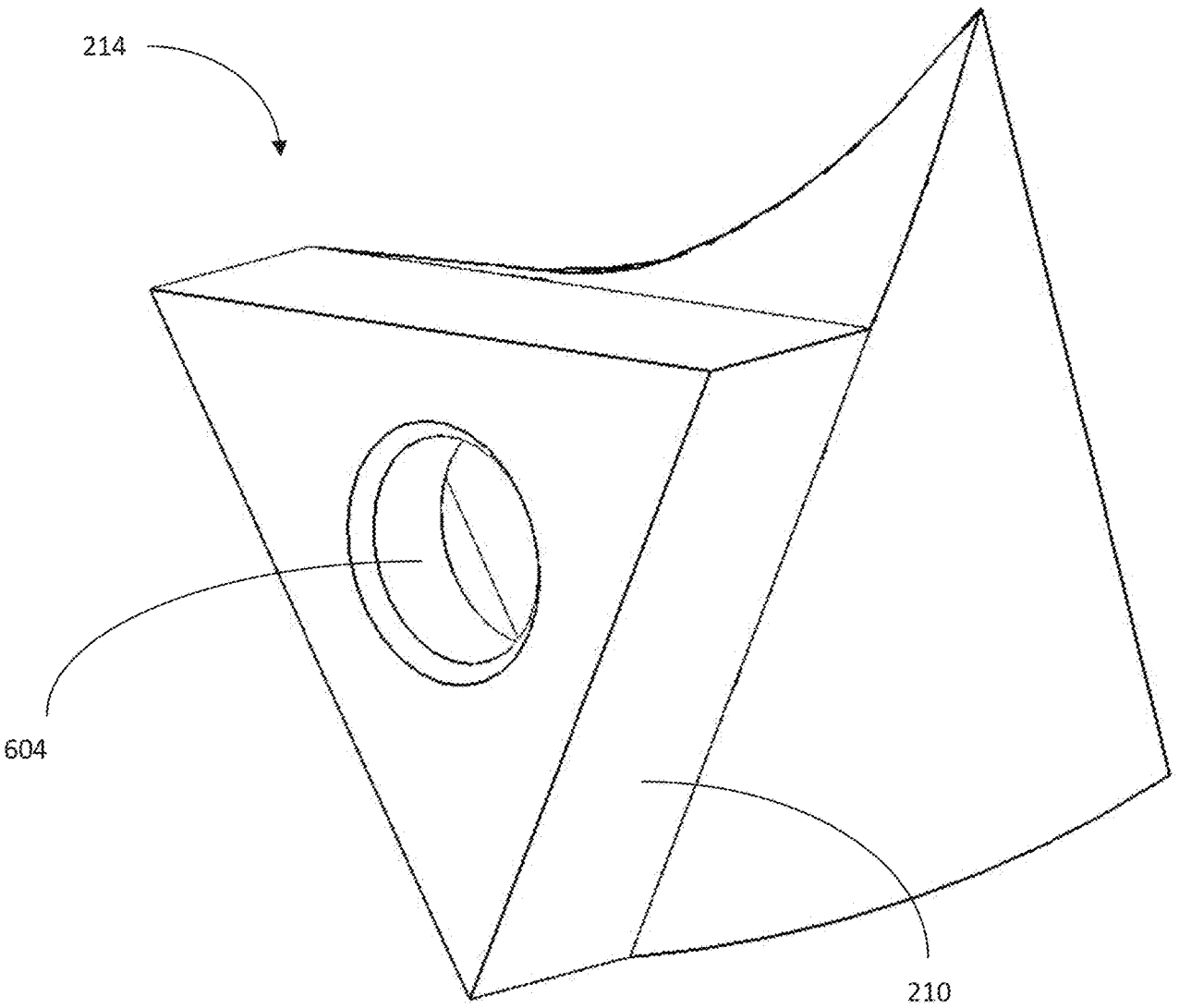
FIG. 9 is an enlarged rearward perspective view of a rearward baffle portion of the helical baffle section assembly, according to at least one embodiment of the present disclosure.

FIG. 9 provides an enlarged perspective view of the first baffle section 214.

Figure 10:
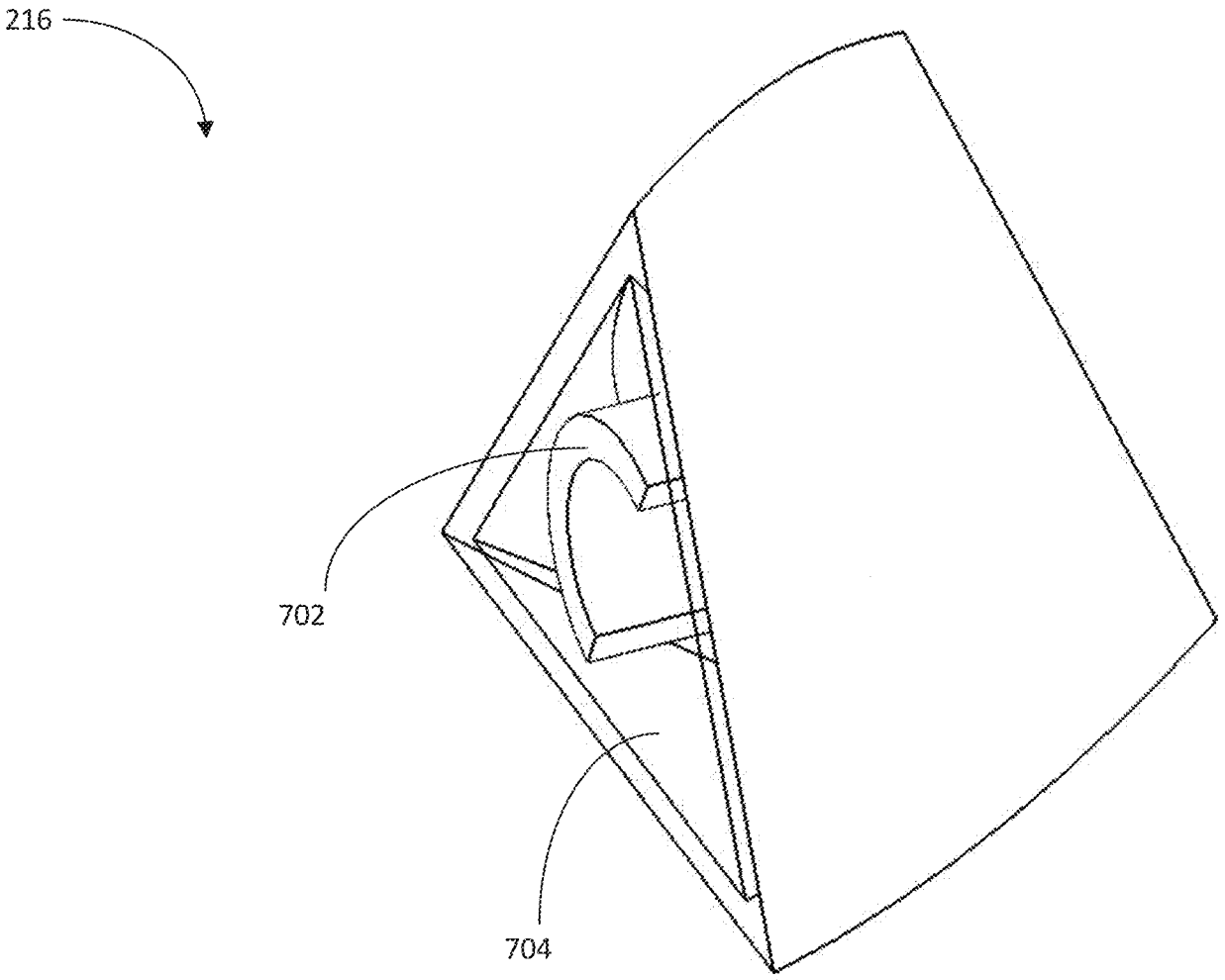
FIG. 10 is an enlarged rearward perspective view of a middle baffle portion of the helical baffle section assembly, according to at least one embodiment of the present disclosure.

FIG. 10 provides an enlarged perspective view of the second baffle section 216. In this view, the hollow void space 704 that is defined by an inner surface of the baffle section and the u-shaped groove 702 may be more readily visible. The hollow void space 704 within the baffle section 216 may comprise a complex geometry and may serve to better disperse and/or distribute propellant gas pressure and/or heat.

Figure 11:
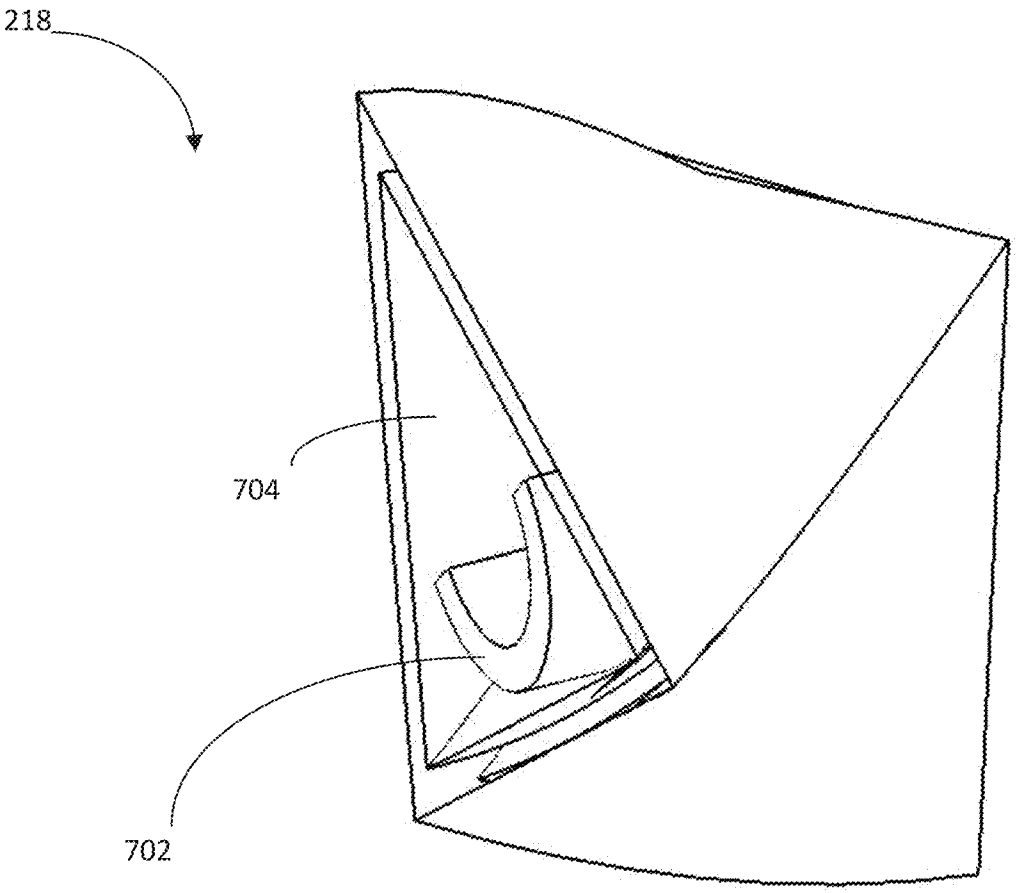
FIG. 11 is an enlarged rearward perspective view of a middle baffle portion of the helical baffle section assembly, according to at least one embodiment of the present disclosure.

FIG. 11 provides an enlarged perspective view of the third baffle section 218. In this view, the hollow void space 704 that is defined by an inner surface of the baffle section and the u-shaped groove 702 may be more readily visible. The hollow void space 704 within the baffle section 216 may comprise a complex geometry and may serve to better disperse and/or distribute propellant gas pressure and/or heat.

Figure 12:
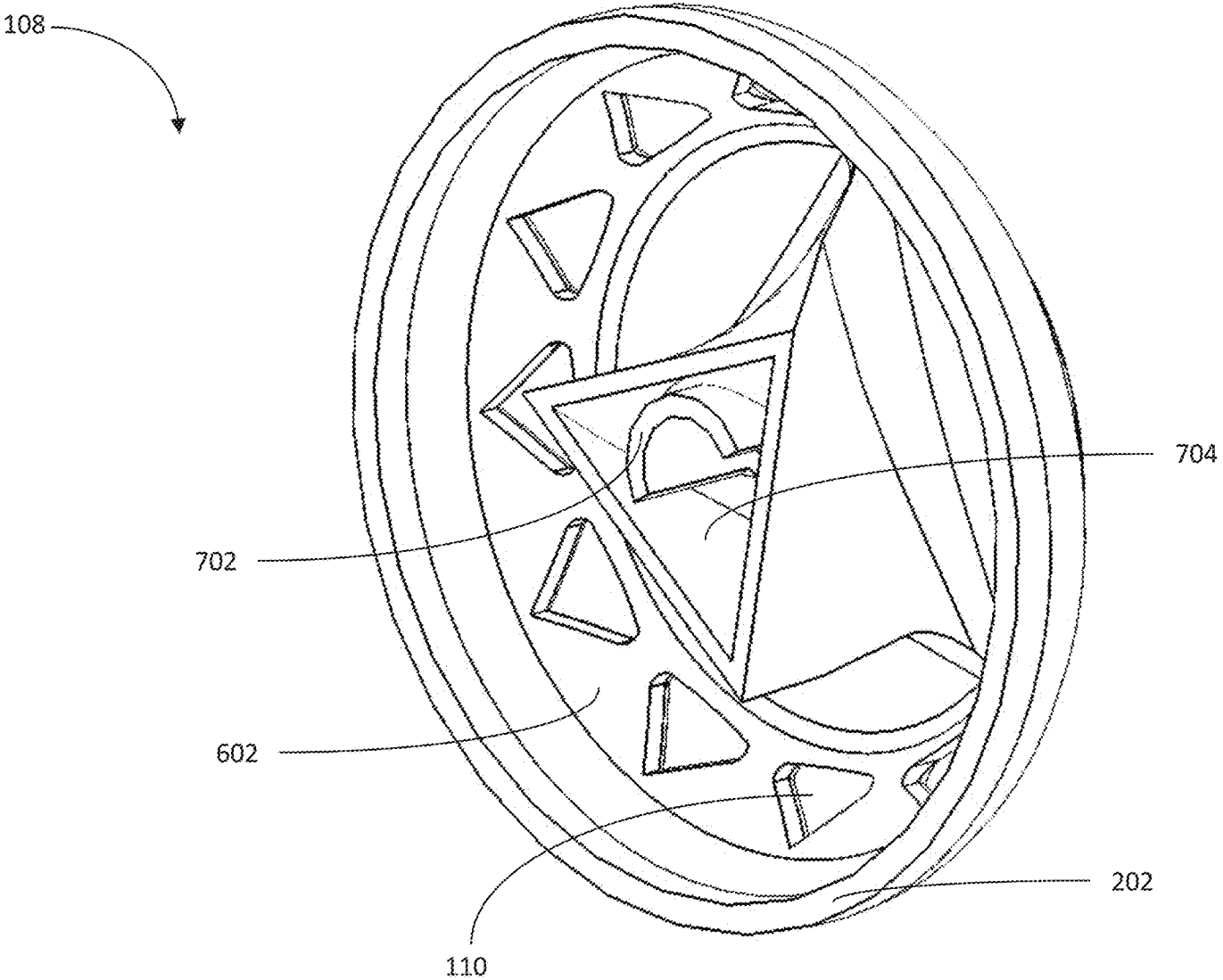
FIG. 12 is an enlarged rearward perspective view of an end cap of the helical baffle section assembly, according to at least one embodiment of the present disclosure.

FIG. 12 provides an enlarged rear perspective view of end cap or forward region 108.

Figure 13:
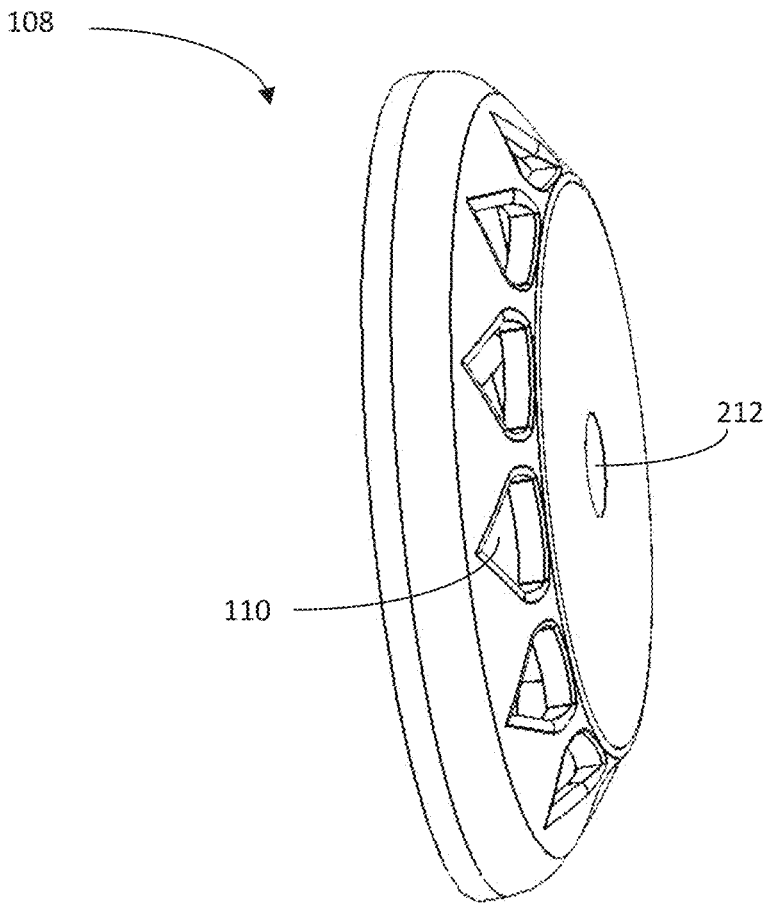
FIG. 13 is an enlarged front and side perspective view of an end cap, according to at least one embodiment of the present disclosure.

FIG. 13 provides an enlarged side perspective view of end cap or forward region 108.

FIG. 14 provides an enlarged cross-sectional view of end cap or forward region 108.

Figure 15:
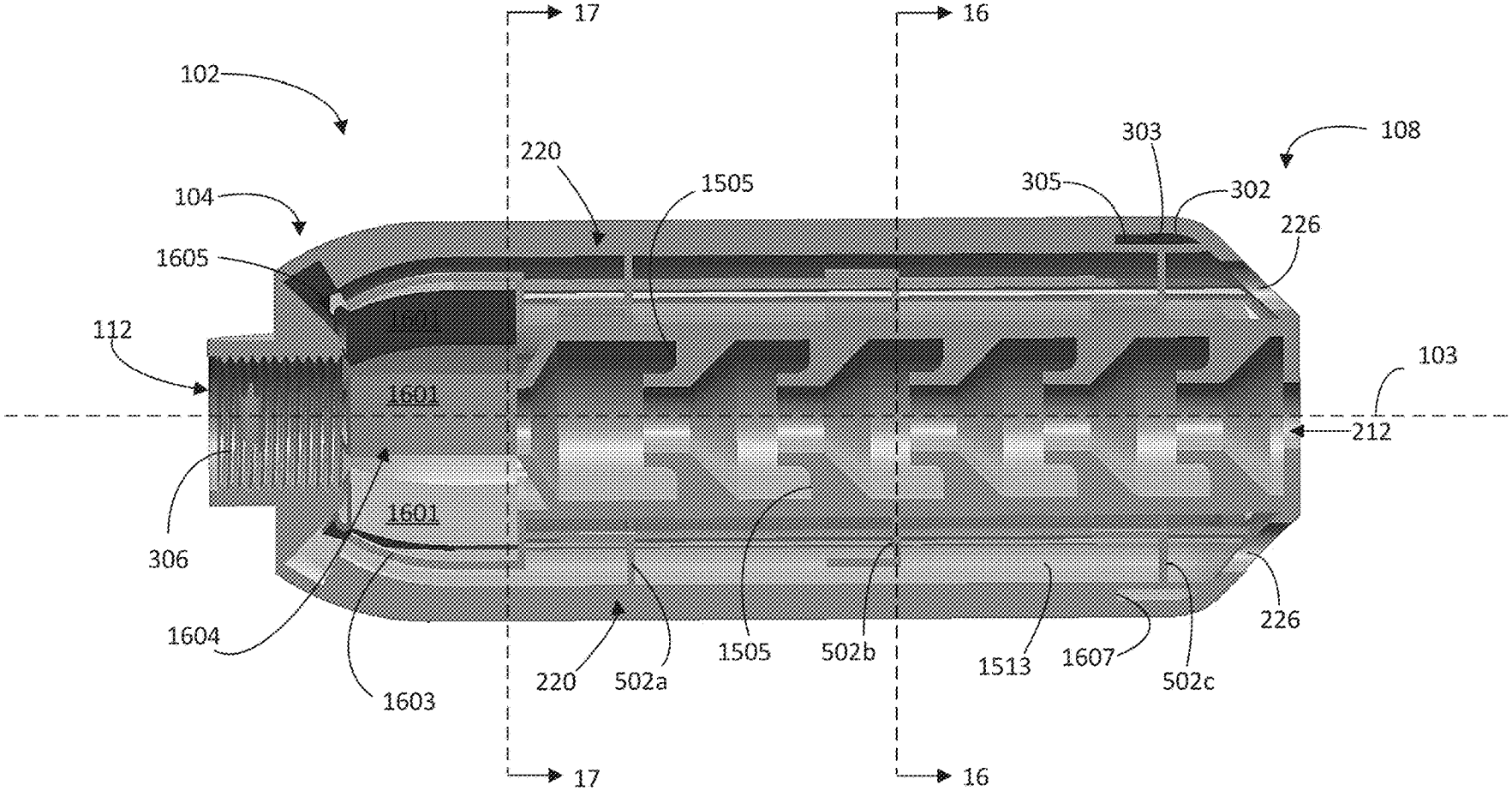
FIG. 15 a view illustrating a cross-sectional cutaway view along a length of the elongate tubular housing of a sound suppressor, according to at least one embodiment of the present disclosure.

Turning to FIG. 15, a cross-sectional view along a length of an example elongate tubular housing 102 is shown for viewing purpose. A plurality of baffle tubes 220 in tubular housing is shown as well as baffle tube exit passages 226. It is noted that baffle tubes 220 may be referred to herein as exterior baffle tubes or exhaust gas baffle tubes herein.

As discussed above, exhaust gas may be flowed through the baffle tubes 220. Baffle tube projections 502 of baffle tubes 202 are visible inside the cut-away of the sample exhaust tubes. It is noted that reference to baffle tube projection 502 refer to baffle projections positioned within the plurality of baffle tubes 220, wherein the plurality of baffle tubes 220 are positioned in a cylindrical array about a central axis 103 of the elongate tubular housing 102. The baffle tube projections 502 define chambers 1513 within the baffle tubes 220. That is, walls of the baffle tubes 220 and the baffle tube projections 502 form chambers 1513 within baffle tubes 220. In at least one example, the chambers 1513 may be rectangular or L-shaped along a longitudinal cross-section of baffle tubes 220 and gas may flow through chambers 1513 which are fluidically connected to each other.

In at least one example, threading 306 may be included near the rearward region 104 of the elongate tubular housing. However the mount of threading may vary by example. In at least one example, it is contemplated that no threading 306 may be included.

Additionally or alternatively, chimneys 1601 may be included near the rearward region 104 of the elongate tubular housing 102. Chimneys 1601 may be chambers that advantageously accept exhaust gases generated when firing a projectile through the elongate tubular housing 102. In one or more examples, chimneys 1601 are passages which route exhaust gas from an entrance chamber 1604 of the elongate tubular housing 102 to the baffle tubes 220.

Chimneys 1601 are features of the baffle tubes 220. That is, chimneys 1601 are integral and part of the baffle tubes 220, in at least one example. Chimneys 1601 may extend parallel to the central axis 103 of the elongate tubular housing 102 and curve inwards towards the central axis 103. In particular, chimneys 1601 may be curved inward towards a central axis 103 of the elongate tubular housing 102 at an end of the chimneys 1601 that is proximal the rearward region 104, while a remainder of the baffle tubes 220 extend substantially parallel to central axis 103. Thus, in at least one example, a curvature of chimneys 1601 may result in the baffle tubes 220 being substantially J-shaped along their respective lengths. That is, a majority of the length of the baffle tubes 220 (e.g., more than 50% of the length, or more than 75% of the length in at least one example) may extend substantially parallel to the central axis 103 with a relatively small portion of a length of the baffle tubes 220 (e.g., less than 50% of the length, or less than 25% of the length in at least one example) curving inwards towards central axis 103.

Put another way, the overall shape of the chimneys 1601 may be elongate with a slight curvature along a longitudinal direction, where the curvature in the longitudinal direction of the chimneys 1601 curves inward at a rearward region 104 of the sound suppressor. In at least one example, the curvature of the chimneys 1601 along a length of each of the chimneys follows a curvature of the exterior. Thus, each of the chimneys 1601 may include a first end near a rearward region 104 that is positioned more closely to a central axis 103 of the sound suppressor than an opposing second end of each of the chimneys 1601. That is, the second end of each of the chimneys 1601 is positioned farther away from a central axis of 103 than the first end of each of the chimneys 1601. The chimneys 1601 surround projectile entrance passage 112. In at least one example, the chimneys 1601 may be distributed equally about a circumference of the sound suppressor such that the chimneys 1601 are spaced equidistant from one another.

Chimneys 1601 form a rearward-most portion of the baffle tubes 220 and are a portion of the baffle tubes 220 nearest the projectile entrance passage 112. During firing, a projectile substantially follows central axis 103 through the elongate tubular housing 102, with the projectile entering at the projectile entrance passage and exiting at exit passage 212. The chimneys 1601, which are near the rearward region 104 of the elongate tubular housing, may be ducts in fluidic communication with an entry chamber 1604 of the elongate tubular housing 102. Entry chamber 1604 may be a chamber immediately downstream of a projectile entrance passage 112 and upstream of all interior baffles 1505 positioned within the elongate tubular housing 102, where upstream and downstream are defined based on a path of the projectile through the elongate housing 102 from entrance passage 112 to exit passage 212.

The chimneys 1601 do not overlap with the interior baffles 1505 of the elongate tubular housing 102. That is, chimneys 1601 do not overlap with the interior baffles 1505 of the elongate tubular housing 102 in either an axial direction or in a radial direction. A wall 1603 defining chimneys 1601 of baffle tubes 220 may be spaced away from a rearward wall of the sound suppressor to form chimney passageway 1605, in at least one example. Thus, the chimney passageway 1605 may allow passage of exhaust gases to chimneys 1601 through chimney passageway 1605. A positioning of chimneys 1601 and chimney passageway 1605 may be particularly advantageous for increasing a speed at which exhaust from entry chamber 1604 may be moved into the baffle system (e.g., around baffle tubes 220). That is, due to a positioning of chimneys 1601 and chimney passageway 1605, exhaust gas may be immediately flowed into chimneys 1601 to quickly relieve pressure in the entry chamber 1604 before flowing exhaust gases through baffle tubes 220 and around interior baffles 1505. Such an approach may beneficially allow for rapid firing of successive rounds while still retaining sound suppressing capabilities. In at least one example, the chimneys 1601 may include baffles positioned therein.

Further, as also illustrated in FIG. 15, the baffle tubes 102 are spaced away from an interior surface 303 of the elongate tubular housing 102. In particular, an exterior surface 305 of the baffle tubes 220 is spaced away from the interior surface 303 of the elongate tubular housing 102 via one or more fins 1607. As the baffle tubes 220 are offset from the elongate tubular housing 102, an amount of heat transfer from the baffle tubes 220 to the elongate tubular housing 102 may advantageously be reduced.

Figure 16:
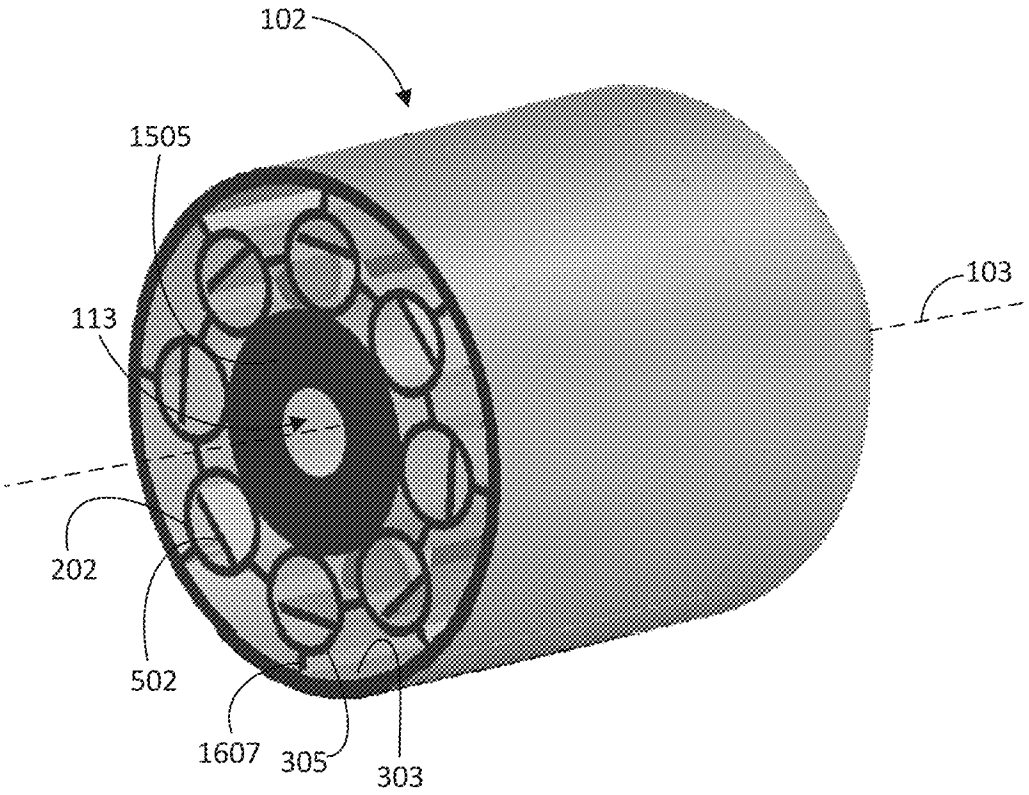
FIG. 16 is a cross-cut view of the elongate tubular housing of the sound suppressor, along line 16-16, illustrating the plurality of exhaust gas baffle tubes, according to at least one embodiment of the present disclosure.

Turning now to FIG. 16, FIG. 16 illustrates a cross-cut view at 16-16 (indicated in FIG. 15) of the elongate tubular housing 102. The plurality of exhaust gas baffle tubes 220, are shown. As shown, the baffle tubes 220 may be circular in cross-section, though other shaping is possible without departing from the scope of the subject application. Moreover, the baffle tube projections 502 may extend across the baffle tubes 220. The baffle tubes 220 are offset from the central axis 103 of the elongate tubular housing. Moreover, the view at FIG. 16 helps to illustrate the discrete formation of the baffle tubes 220. That is, each of the baffle tubes 220 is a self-contained, discrete suppressor positioned within one overall suppressor (the elongate tubular housing 102). The baffle tubes 220 extend parallel to one another, and the baffle tubes 220 are non-communicative with each other from an entrance of each of the baffle tubes at the rearward region of the elongate tubular housing to their exits at 226. Put another way, walls defining the baffle tubes 220 are solid, preventing exhaust from exiting the baffle tubes 220 from an entrance of the baffle tubes 220 to an exit of the baffle tubes. Thus, exhaust gas is separately flowed between the entrances and exits of the baffle tubes 220.

As may be seen in FIG. 16, structural fins 1607 may extend from an exterior surface of the baffle tubes 305 to an interior surface 303 of the elongate tubular housing 102. Such structural fins 1607 space the baffle tubes 220 away from the interior surface 303 of the elongate tubular housing. Such spacing may help to improve a structural integrity of the suppressor as well as to reduce heat transfer from the baffle tubes 305 to the interior surface 303 of the elongate tubular housing 102. Thus, in at least one example, the plurality of baffle tubes 220 are offset from the elongate tubular housing 102 and offset from the central axis 103.

In the interior of the suppressor, interior baffles 1505 may define an opening 113, which aligns with the projectile entrance passage 112. In at least one example, opening 113 may be positioned in the center of each of the interior baffles 1505.

Figure 17:
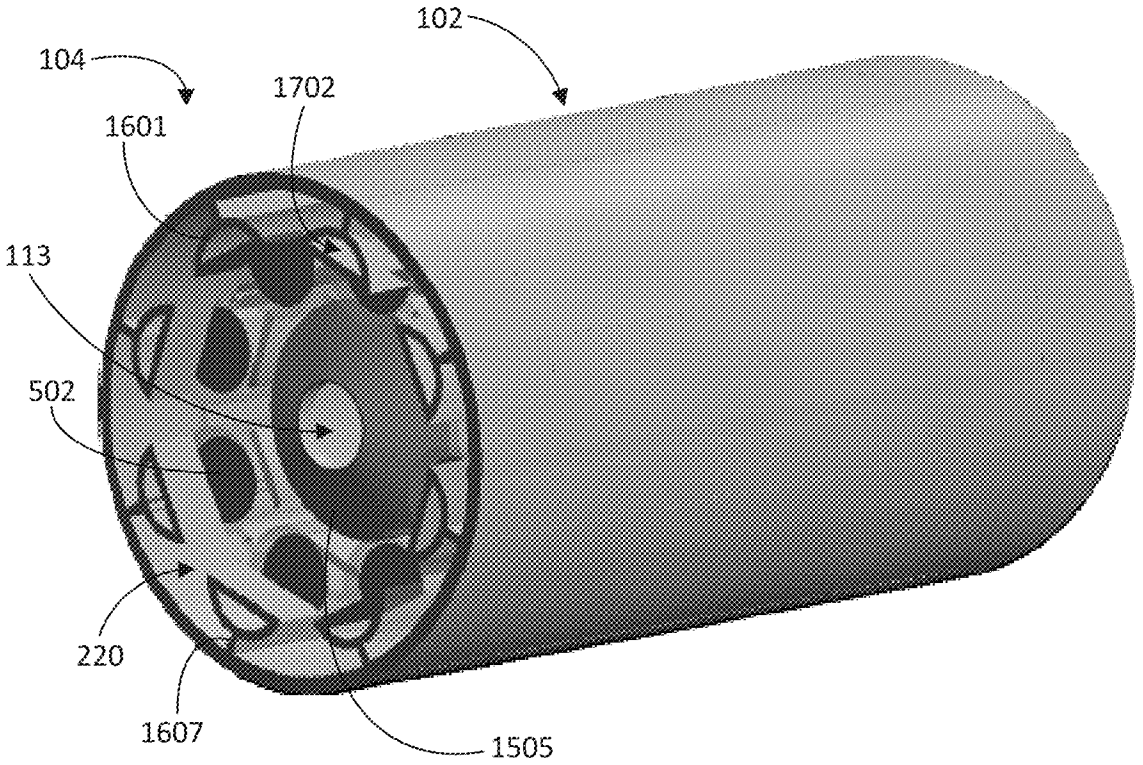
FIG. 17 is a cross-cut view of the elongate tubular housing of the sound suppressor, along line 17-17, illustrating the chimneys, according to a least one embodiment of the present disclosure.

FIG. 17 illustrates a cross-cut view along 17-17 (as illustrated in FIG. 15) of the elongate tubular housing 102. 17-17 is a cross-cut view near rearward region 104 of the suppressor.

Interior baffles 1505 are shown in the interior of the suppressor, surrounding and defining opening 113. Surrounding the interior baffles 1505 in the interior of the suppressor are the baffle tubes 220, which comprise chimneys 1601. The chimneys 1601 may form a passageway that is narrower than the baffle tube portions in at least one example. Furthermore, the chimneys 1601 include a baffle tube entrance 1702. Via the baffle tube entrance 1702, exhaust may flow into the baffle tube 220, past baffle tube projections 502, and out of the baffle tube exits (e.g., exit passages 226). While flowing exhaust gas between the baffle tube entrances 1702 and exit passages 226 of the discrete baffle tubes 220, the exhaust gas is not communicated between the baffle tubes 220.

In one example, chimneys 1601 are positioned near the rearward region 104 of the suppressor. In at least one example, the chimneys 1601 may be distributed equally about a circumference of the sound suppressor such that the chimneys 1601 are spaced equidistant from one another. In at least one example there may be four chimneys 1601 in total, though more or fewer chimneys 1601 be included without departing from the scope of this disclosure.

Figure 18:
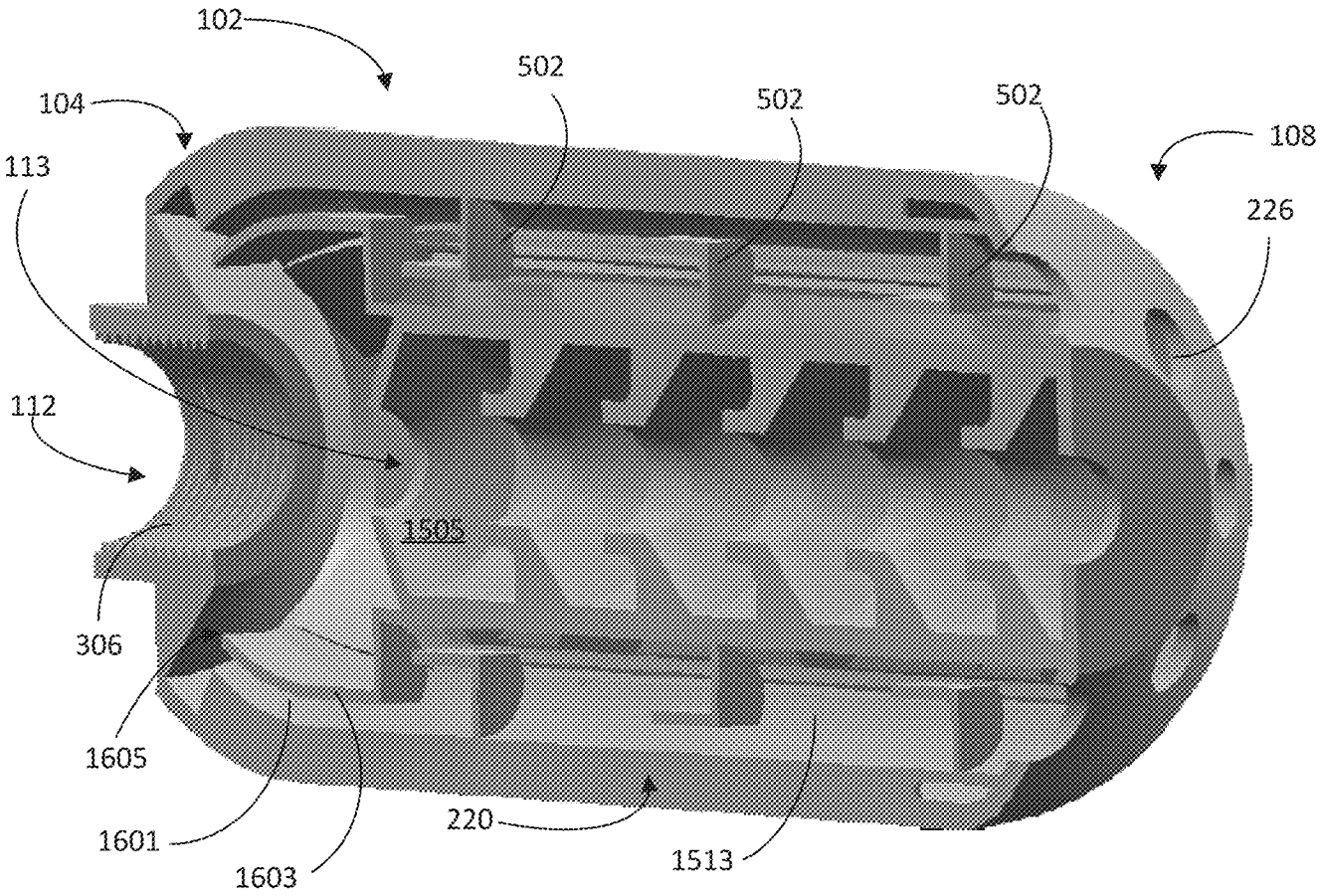
FIG. 18 is cross-sectional cutaway view of the elongate tubular housing of the sound suppressor illustrating the interior of sample exhaust gas baffle tubes, according to at least one embodiment of the present disclosure.

In FIG. 18, a longitudinal cross-section perspective view of the elongate tubular housing 102 is shown with baffle tube exit passages 226. As shown in FIG. 18, the exterior baffle tube projections 502 are visible inside the cut-away of the sample exhaust gas baffle tubes 220. The exterior baffle tube projections 502 define chambers 1513 within baffle tubes 220, wherein the chambers 1513 are fluidically coupled to the chimneys 1601 for each respective baffle tube 220. Thus, exhaust gas may be flowed from the chimneys 1601, around the exterior baffle tube projections 502, and out of baffle tube exit passages 226 for each respective baffle tube 220. Though the baffle tube projections 502 are only shown positioned downstream of the chimneys 1601, in at least one example the chimneys 1601 may also include such baffle tube projections 502.

Figure 19:
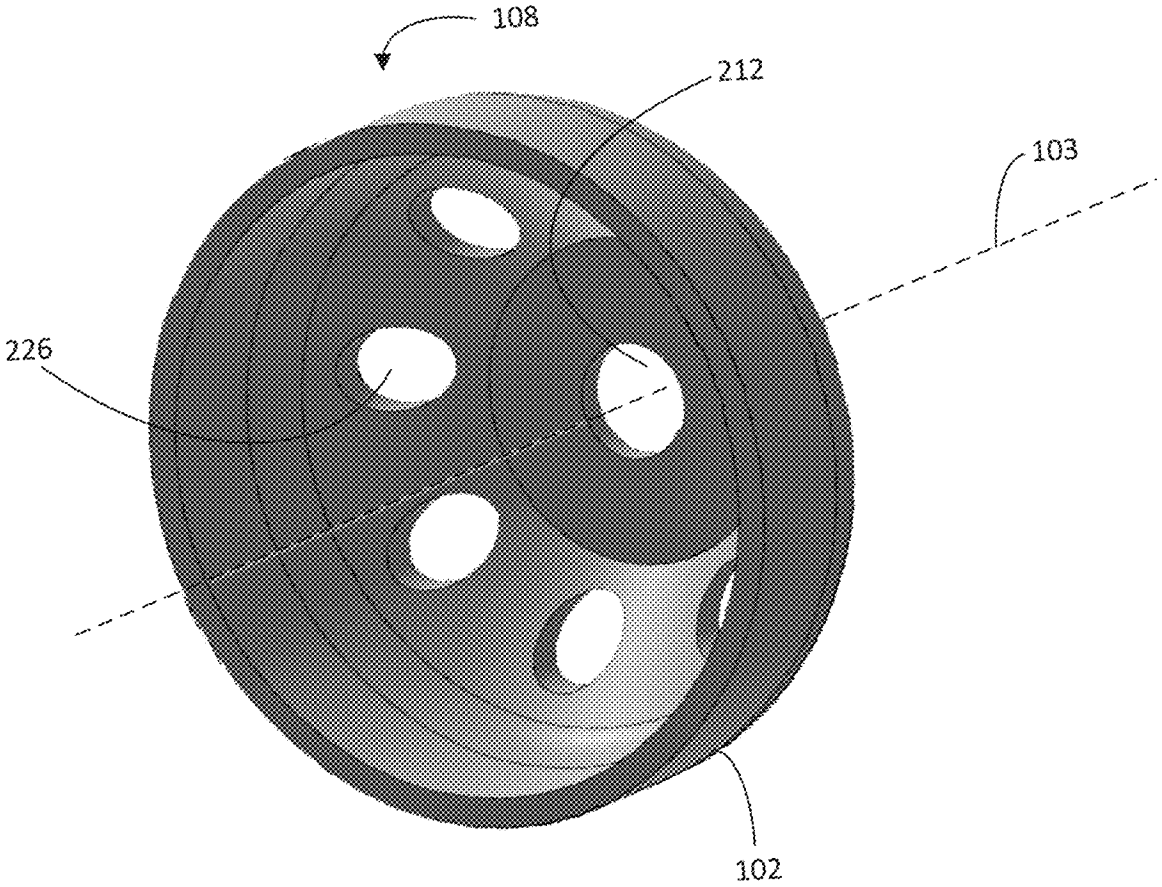
FIG. 19 is a perspective view of a forward region of the elongate tubular housing, according to at least one embodiment of the present disclosure.

Turning now to FIG. 19, FIG. 19 shows a view of a forward region 108 of the tubular housing 102 for the sound suppressor. As can be seen in FIG. 19, the forward region 108 includes the baffle tube exit passages 226 which are formed into the tubular housing 102. The baffle tube exit passages 226 surround a central axis 103 of the sound suppressor, where the projectile exit passage 212 is aligned with the central axis 103 of the sound suppressor.

Figure 20:
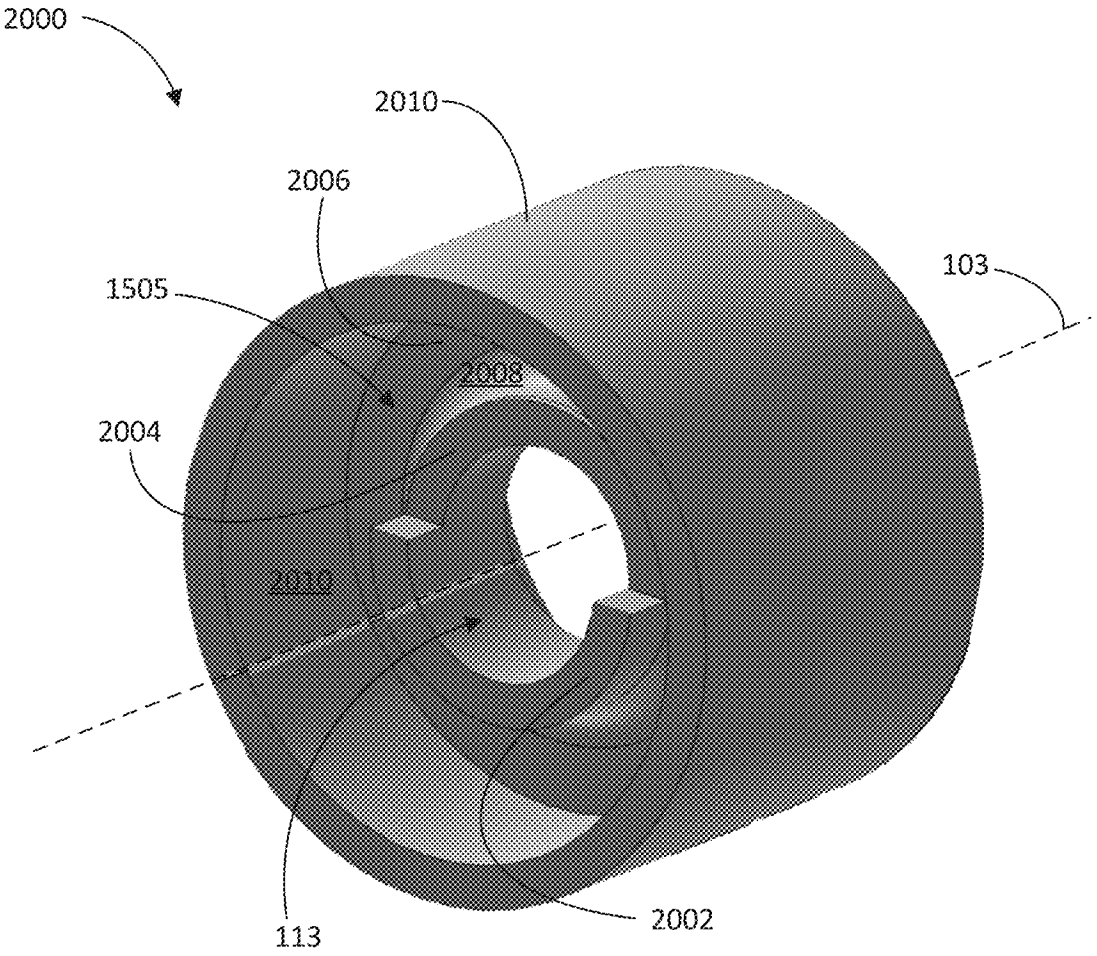
FIG. 20 is a perspective view of a portion of the elongate tubular housing that includes an interior baffle, according to at least one embodiment of the present disclosure.

Looking now to FIG. 20, FIG. 20 a perspective view 2000 of a segment of the sound suppressor which includes an interior baffle 1505 is shown. As seen in FIG. 20, the interior baffle 1505 includes a leading face 2002 and a trailing face 2004. The interior baffle 1505 may be retained within an interior baffle tube 2010 in at least one example, where the interior baffle tube 2010 is positioned within the elongated tubular housing 102 of the sound suppressor. In at least one example, an exterior surface the plurality of baffle tubes 220 may form the interior baffle tube 2010. However, it is also possible for the interior baffle tube 2010 to be a separate component. The leading face 2002 may follow alongside approximately half of the circumference of opening 113 of the interior baffle 1505. In the example shown at FIG. 20, the leading face 2002 forms a C-shaped structure. However, other shapes may be used. The leading face 2002 may extend where the leading face 2002 may project from the trailing face 2004 of the interior baffle 1505. A shape of the trailing face 2004 of the interior baffle 1505 may be symmetrical to the leading face 2002. In the example shown at FIG. 20, the trailing face forms a structure that mirrors the leading face 2002. Such mirroring of the structures may advantageously improve a structural stability of the interior baffle 1505. The trailing face 2004 is downstream of the leading face 2002, and the trailing face 2004 also extends along the circumference of the opening 113 of the interior baffle. An inclined portion 2008 of the interior baffle 1505 extends from the leading and trailing faces 2002, 2004 to a base 2006 of the interior baffle 1505. The base of the interior baffle 1505 may extend from an interior surface 2010 of the interior baffle tube 2010 to the inclined portion 2008 of the interior baffle 1505. In this way, a residency time of the exhaust gas flowing through the interior baffle tube 2010 may be increased, helping to suppress a sound caused during a firing event.

Figure 21C:
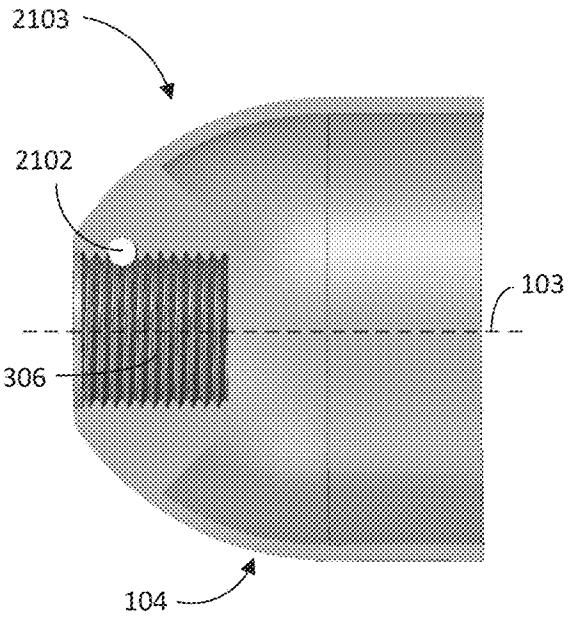
FIG. 21*c* is a third view of the rearward region of the elongate tubular housing, according to at least one embodiment of the present disclosure.
Figure 21B:
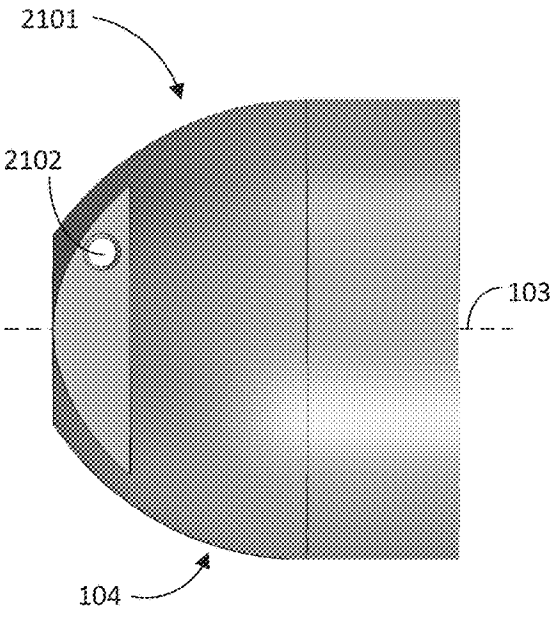
FIG. 21*b* is a second view of the rearward region of the elongate tubular housing, according to at least one embodiment of the present disclosure.
Figure 21A:
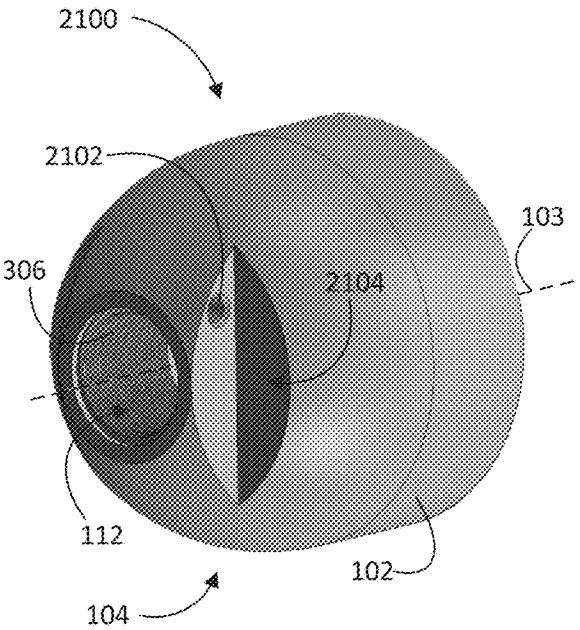
FIG. 21*a* is a first view of a rearward region of the elongate tubular housing, according to at least one embodiment of the present disclosure.

Turning now to FIG. 21*a*, FIG. 21*b*, and FIG. 21*c*, a perspective view 2100, side view 2101, and a cutaway side view 2103 for a rearward region 104 of the sound suppressor are shown, respectively. As seen in the views at FIGS. 21*a*, 21*b*, and 21*c*, the rearward region 104 of the sound suppressor includes a retaining pinhole 2102 for receiving a retaining pin. The retaining pinhole 2102 may be positioned through a recessed region 2104 of the elongated tube 102. Such positioning of the retaining pinhole 2102 in the recessed region 2104 may beneficially help to keep a juncture at which a firearm and the sound suppressor coupled via a retaining pin in the retaining pinhole 2102 relatively smooth.

The retaining pinhole 2102 is further in a region of the mounting threads 306 and may advantageously be used in combination with the mounting threads 306 to fix the sound suppressor to a firearm. For example, the retaining pinhole 2102 may overlap a portion of the mounting threads 306, as shown at FIG. 21*c*. Retaining pinhole 2102 is particularly desirable where quick changed barrels are employed on high rate of fire guns, as the retaining pinhole 2102 acts as a redundant feature to ensure suppressor does not loosen and misalignment does not result. The retaining pinhole 2102 further acts as an anti-tamper feature making sure the barrel and suppressor are not separated in the field and acts as a redundant retention feature to thread torque especially during extreme thermal loads while incurring high rates of fire.

In particular, the retaining pinhole 2102 may be blind so that one end is closed and the pin may be driven in, but not driven out, making the attachment to the barrel semi-permanent. Thus, although the retaining pinhole 2102 is shown already drilled out, the retaining pinhole 2102 is originally filled in. For example, the retaining pinhole 2102 may be fully or partially printed via additive manufacturing (3D printing) full of low-density material, making retaining pinhole 2102 hole easily drilled even though the material of the elongated tube 102 surrounding the retaining pinhole 2102 may be difficult to machine. In at least one example, the material of the elongated tube 102 surrounding the retaining pinhole 2102 may comprise a metal such as nickel, which would be very difficult to machine, and the material for the retaining pinhole 2102 may comprise a low density printed material. This allows the suppressor to be manufactured with this feature and the end user can select if they wish to drill out the retaining pinhole 2102 for use.

Figure 22:
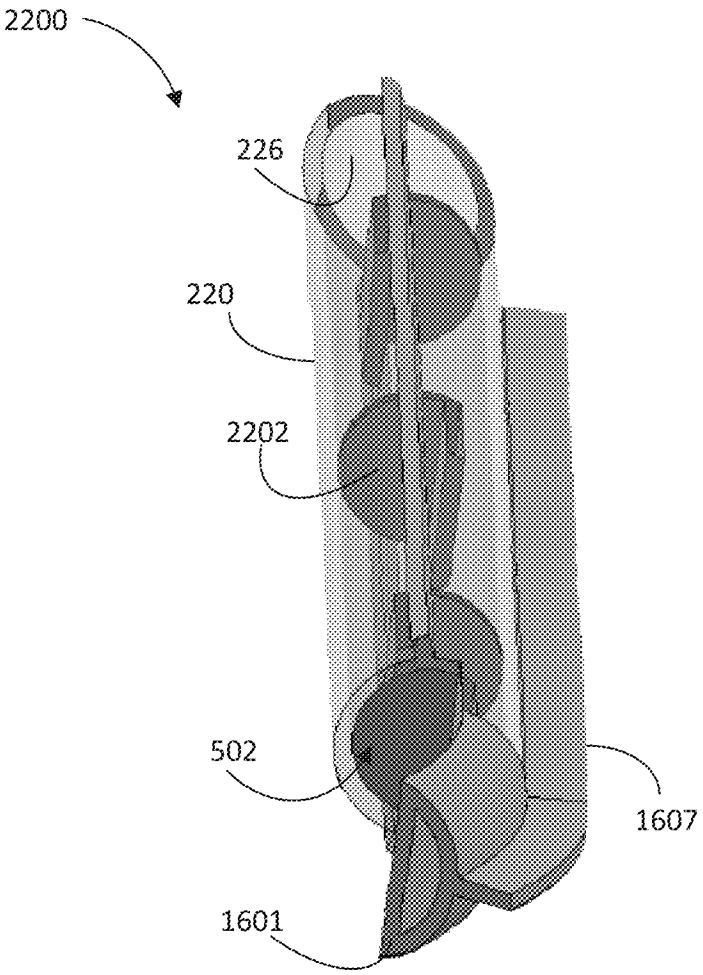
FIG. 22 is a perspective view of one of the plurality of baffle tubes, according to at least one embodiment of the present disclosure.

Turning now to FIG. 22, FIG. 22 shows a perspective view 2200 of a baffle tube 220, where walls of the baffle tube 220 have been made translucent to allow viewing of a shape of the exterior baffle tube projections 502. As can be seen, a first surface 2202 of the exterior baffle tube projections 502 that extends in a direction perpendicular to a length of the baffle tube 220 is substantially semi-circular in shape. Further, a second surface 2204 of the exterior baffle tube projections 502 is a quadrilateral, where the second surface 2204 is perpendicular to the first surface 2202. The second surface 2204 extends in a direction that is substantially parallel to the length of the baffle tube 220. Further, as seen in FIG. 22, structural fin 1607 extends for more than half the length of the baffle tube 220 along an exterior surface of the baffle tube 220. The structural fin 1607 may space the baffle tube 220 away from an interior surface of the elongate tubular housing. In at least one example, there may be multiple structural fins 1607, as shown FIG. 22.

It will be understood that the figures are provided solely for illustrative purposes and the embodiments depicted are not to be viewed in a limiting sense. From the above description, it can be understood that the energy suppressor and/or combination of the energy suppressor and firearm disclosed herein and the methods of making them have several advantages, such as: reducing the time required to achieve a pressure reduction of the exhaust gasses of the firearm thereby avoiding mechanical malfunction of auto-loading firearms; reducing the mirage effect by minimizing the thermal transfer from the baffle exhaust gas tubes to the outer wall of the suppressor; improving accuracy and reliability; aiding in the dissipation of heat and reduce the tendency of the energy suppressor to overheat; and manufacturing reliability and predictability with desirable characteristics in an economical manner.

It is further understood that the firearm sound suppressor described and illustrated herein represents only example embodiments. It is appreciated by those skilled in the art that various changes and additions can be made to such firearm sound suppressor without departing from the spirit and scope of this disclosure. For example, the firearm sound suppressor could be constructed from lightweight and durable materials not described.

Thus, provided is a sound suppressor that may be coupled with a firearm. In a first example sound suppressor, the sound suppressor may comprise an elongate tubular housing, a projectile entrance passage positioned at a rearward region of the elongate tubular housing, and a plurality of tubes positioned within the elongate tubular housing, where the plurality of tubes are spaced away from an interior surface of the elongate tubular housing. In a second example sound suppressor, which may optionally include the features of the first example sound suppressor, each of the plurality of tubes comprises a plurality of projections positioned therein. For example, the plurality of projections may extend towards a central axis of the respective tube within which they are positioned.

In at least one example sound suppressor, which may additionally include any one or combination of the above described features, the plurality of tubes do not contact an interior surface of the elongate tubular housing. Thus, the plurality of tubes may be positioned within the elongate tubular housing without contacting the interior surface of the elongate tubular housing. Moreover, in at least one example, the sound suppressor may comprise at least one helical fluted section positioned within the elongate tubular housing, wherein a portion of the helical fluted section is positioned between a portion of at least one of the plurality of tubes and the interior surface of the elongate tubular housing. However, a lumen may be formed between a majority of a length of the plurality of tubes and the interior surface of the elongate tubular housing. Thus, sections where the helical fluted section may be positioned between one of the tubes and the interior surface of the elongate tubular housing may be minimal.

Furthermore, in at least one example sound suppressor which may include one or more of the above features, the sound suppressor may further comprise a plurality of exhaust gas venting ports formed into a forward region of the elongate tubular housing, each of the plurality of tubes communicating with a separate exhaust gas venting port of the plurality of exhaust gas venting ports. Such exhaust gas venting ports may help to efficiently reduce a pressure due to exhaust gas within the sound suppressor, thus reducing a noise caused by a firing event. Moreover, the exhaust gas venting ports may be positioned so as to direct exhaust gas in a manner that does not interfere with a sight on the firearm and that does not direct the exhaust gas towards a user. In at least one example, the one or more exhaust gas venting ports formed into a front face of the sound suppressor.

For example, the exhaust gas venting ports may open in a same direction as the projectile path, or, in other words, in a direction towards the forward region of the elongate tubular housing. Other opening directions for the exhaust gas venting ports may be possible, however, so long as the exhaust gas venting ports do not open towards a rearward region of the firearm. For example, the exhaust gas venting ports may open in a direction perpendicular relative to a central axis of the elongate tubular housing, that is, in a direction tangent to the elongate tubular housing.

In another example sound suppressor, a central axis of each of the plurality of tubes may be non-coaxial to a central axis of the elongate tubular housing. Such a positioning of the plurality of tubes provides a clear passage for a projectile to travel through the elongate tubular housing along the central axis of the elongate tubular housing, while also providing multiple torturous paths for exhaust gas to be passed through prior to the exhaust gas exiting the elongate tubular housing. In at least one example, the central axis of each of the plurality of tubes may be approximately parallel to the central axis of the elongate tubular housing. An example sound suppressor comprising any one or more features as described above may be coupled to a firearm via a coupling mechanism at a rearward region of the sound suppressor as a part of a firearm system. In at least one example, the coupling mechanism may comprise threading. In at least one example, the firearm may be an autoloading firearm.

It is noted that in at least one example, the sound suppressor disclosed herein may be produced as a single, unitary piece via additive manufacturing, such as 3D printing. By producing the sound suppressor disclosed herein in a single unitary piece, the resulting sound suppressor may be stronger compared to other components which may instead include multiple pieces. Moreover, producing the sound suppressor via additive manufacturing may have advantages over other approaches that may utilize molding production methods. This is not least because producing a mold with a shaping as complex as the shaping of the sound suppressor described herein may be time consuming or the actual production of the sound suppressor via a molding process may require multiple molding stages to form the various shapes within the sound suppressor.

Thus, disclosed herein are sound suppressors and firearms. A first sound suppressor comprises an elongate tubular housing, a projectile entrance passage at a rearward portion of the elongate tubular housing, and a plurality of tubes positioned within the elongate tubular housing, wherein the plurality of tubes are offset from the elongate tubular housing and offset from a central axis of the elongate tubular housing.

In a first example of the first sound suppressor, the plurality of tubes are non-communicative with each other from an entrance to an exit of each of the plurality of tubes. In a second example of the first sound suppressor which optionally includes the first example, the sound suppressor is formed as a single, unitary piece. In a third example of the first sound suppressor, which optionally includes one or both of the first and second examples, the sound suppressor is formed via additive manufacturing. In a fourth example of the first sound suppressor, which optionally includes any one or more of the first through third examples, a rearward portion of the elongate tubular housing includes a retaining pinhole. In a fifth example of the first sound suppressor, which optionally includes any one or more of the first through fourth examples, each of the plurality of baffle tubes comprises a chimney portion that is narrower than a remainder of the plurality of baffle tubes, and a wall defining the chimney portion of the baffle tube may be exposed to an entry chamber of the elongate tubular housing, the entry chamber is a chamber positioned immediately downstream of the projectile entrance passage. In a sixth example of the sound suppressor, which optionally includes any one or more of the first through fifth examples, the wall defining the chimney portion of the baffle tube curves towards a central axis of the elongate tubular housing.

A second sound suppressor, which includes any one or combination of features described in relation to the first sound suppressor, comprises an elongate tubular housing, a projectile entrance passage positioned at a rearward region of the elongate tubular housing, at least one interior baffle positioned within the elongate tubular housing, and a plurality of tubes positioned around the at least one interior baffle, wherein each of the plurality of tubes comprises at least one baffle positioned therein, wherein each of the plurality of tubes includes an end proximal the projectile entrance passage, and wherein each of the plurality of tubes further includes a chimney at the end proximal the projectile entrance passage that is positioned upstream the at least one interior baffle. In a first example of the second sound suppressor, the end proximal the projectile entrance passage includes a retaining pinhole and threading. In a second example of the second sound suppressor, which optionally includes the first example, the chimney is fluidically coupled to an entrance chamber of the sound suppressor that is immediately downstream the projectile entrance passage. In a third example of the second sound suppressor, which optionally includes one or both of the first and second examples, the plurality of tubes do not contact an interior surface of the elongate tubular housing. In a fourth example of the second sound suppressor, which optionally includes one or more of the first through third examples, the end proximal the projectile entrance passage of the chimney curves towards the central axis. In a fifth example of the second sound suppressor, which optionally includes one or more of the first through fourth examples, the chimney of each of the plurality of tubes is narrower than a remainder of the tube. In a sixth example of the second sound suppressor, which optionally includes one or more of the first through fifth examples, the chimneys of the plurality of tubes do not overlap with the at least one interior baffle. In a seventh example of the second sound suppressor, which optionally includes one or more of the first through sixth examples, the chimneys of the plurality of tubes do not overlap with the at least one interior baffle in an axial direction and in a radial direction of the elongate tubular housing.

Further disclosed herein is a firearm system comprising a firearm and a sound suppressor, wherein the sound suppressor includes any one or combination of the sound suppressors described above. The sound suppressor of the firearm system is coupled to the firearm via a coupling mechanism at a rearward region of the sound suppressor, the sound suppressor including an elongate tubular housing, a plurality of interior baffles positioned within the elongate tubular housing, a plurality of tubes positioned within the elongate tubular housing and surrounding the plurality of interior baffles, wherein interiors of the plurality of tubes are fluidically isolated from each other, and wherein the plurality of tubes are offset from a central axis of the elongate tubular housing. In a first example of the firearm system, each of the plurality of tubes includes a chimney portion positioned at the rearward region of the sound suppressor, and the plurality of tubes extend parallel to the central axis. In a second example of the firearm system, which optionally includes the first example, the coupling mechanism comprises threading and a retaining pinhole. In a third example of the firearm system, which optionally includes one or both of the first and second examples, an entry chamber is fluidically coupled to the chimney portion, the entry chamber being a chamber positioned immediately adjacent a projectile entrance passage. In a fourth example of the firearm system, which optionally includes one or more of the first through third examples, interior baffles define openings that are aligned with a central axis of the elongated tubular housing.

As used herein, an element or step recited in the singular and then proceeded with the word "a" or "an" should be understood as not excluding the plural of said elements or steps, unless such exclusion is explicitly stated. Furthermore, references to "one embodiment" of the present subject matter are not intended to be interpreted as excluding the existence of additional embodiments that also incorporate the recited features. Moreover, unless explicitly stated to the contrary, embodiments, "comprising," "including," or "having" an element or a plurality of elements having a particular property may include additional such elements not having that property. The terms "including" and "in which" are used as the plain-language equivalents to the respective terms "comprising" and "wherein." Moreover, the terms "first," "second," and "third," etc. are used merely as labels, and are not intended to impose numerical requirements or a particular positional order on their objects.

This written description uses examples to disclose the invention, including best mode, and also to enable a person of ordinary skill in the relevant art to practice the invention, including making and using any devices or systems and performing any incorporated methods.

It will be appreciated that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various features, functions, acts, and/or properties disclosed herein, as well as any and all equivalents thereof.

In one representation, a suppressor is provided formed of a unitary material, such as via laser metal sintering or another related process such as 3D printing. The suppressor may include one or more structural features to internally route gasses, in additional one or more optional baffles. For example, to mitigate the issues related to excess heat build-up, baffled exhaust tubes may be positioned longitudinally and with central axes in parallel with a barrel of the firearm. In one example, the tubes are not tangent with or directly touching the inside of the outer wall of the suppressor, nor are they directly touching each other. The plurality of baffled exhaust gas tubes may instead be contained within fluted spiral structures that follow a rifling pattern about a central axis along the longitudinal length of the suppressors' inner body wall.

It should be appreciated that while the suppressor may be unitary in its construction, and thus in a sense virtually all of its components could be said to be in contact with one another, the terms used herein are used to refer to a more proper understanding of the term that is not so broad as to mean simply that the various parts are connected or contacting through a circuitous route because a single unitary material forms the suppressor.

The invention claimed is:

1. A suppressor, comprising:

an elongate housing;

one or more baffles within a baffle chamber;

a projectile entrance;

a projectile exit in an egress end of the elongate housing; and a plurality of tubes positioned within the elongate housing, each of the plurality of tubes comprises a tube entrance on an end of the suppressor near the projectile entrance and a tube exit though a wall of the elongate housing on the egress end of the elongate housing, wherein the suppressor is formed via 3D printing.

2. The suppressor of claim 1, wherein the plurality of tubes are non-communicative with other tubes or the baffle chamber from the tube entrance to the tube exit.

3. The suppressor of claim 1, wherein the suppressor is formed as a monolithic, unitary piece.

4. The suppressor of claim 1, wherein sidewalls connect the egress end and an ingress end of the elongate housing, and an air gap is positioned between the plurality of tubes and the sidewalls of the elongate housing.

5. The suppressor of claim 1, wherein the plurality of tubes extend in a direction of a central axis of the suppressor, and each of the plurality of tubes comprises a chimney portion that curves toward the central axis of the suppressor.

6. The suppressor of claim 1, wherein the plurality of tubes comprise baffles within the tubes.

7. A suppressor, comprising:

an elongate housing;

one or more baffles within a baffle chamber;

a projectile entrance;

a projectile exit; and a plurality of tubes, each of the plurality of tubes extends from a tube entrance on an end of the suppressor with the projectile entrance to a tube exit though an exterior wall of the elongate housing, wherein the suppressor is formed via 3D printing.

8. The suppressor of claim 7, wherein each of the plurality of tubes forms a separate gas passage from the tube entrance to an exterior of the suppressor.

9. The suppressor of claim 7, wherein a chimney forms the tube entrance and a central axis of the chimney curves towards a central axis of the suppressor.

10. The suppressor of claim 7, wherein sidewalls extend from an end of the suppressor comprising the projectile entrance to an end of the suppressor comprising the projectile exit, and the plurality of tubes do not contact an interior surface of the sidewalls.

11. The suppressor of claim 10, wherein an air gap is positioned between the plurality of tubes and the interior surface of the sidewalls.

12. The suppressor of claim 9, wherein the chimney of each of the plurality of tubes is narrower than a remainder of the tube.

13. The suppressor of claim 7, wherein the baffle chamber is interior to the plurality of tubes and the plurality of tubes are interior to the elongate housing.

14. The suppressor of claim 7, wherein the plurality of tubes extend parallel to a central axis of the suppressor and are positioned around an interior surface of sidewalls of the elongate housing.

15. A firearm system, comprising:

a firearm; and a suppressor comprising:

an elongate housing;

one or more baffles within a baffle chamber;

a projectile entrance;

a projectile exit; and a plurality of tubes, each of the plurality of tubes forming a separate gas passage from a tube entrance at a first end of the suppressor to a tube exit though an exterior wall of the elongate housing at a second end of the suppressor, wherein the suppressor is formed via 3D printing.

16. The firearm system of claim 15, wherein the plurality of tubes include baffles within the tubes.

17. The firearm system of claim 15, wherein a chimney forms one or more of the tube entrances and the one or more chimneys curve toward a central axis of the suppressor.

18. The firearm system of claim 15, wherein the baffle chamber is a separate gas passage from the plurality of tubes.

19. The firearm system of claim 15, wherein the one or more baffles within the baffle chamber are coupled to the plurality of tubes.

* * * * *